US009688503B2

(12) United States Patent
Fukasawa et al.

(10) Patent No.: US 9,688,503 B2
(45) Date of Patent: Jun. 27, 2017

(54) SHEET PROCESSING DEVICE, IMAGE FORMING DEVICE PROVIDED WITH THE SAME, AND FOLDED SHEET PRESSING METHOD

(71) Applicants: Takeshi Fukasawa, Yamanashi-ken (JP); Hisashi Osada, Yamanashi-ken (JP); Akira Takei, Yamanashi-ken (JP)

(72) Inventors: Takeshi Fukasawa, Yamanashi-ken (JP); Hisashi Osada, Yamanashi-ken (JP); Akira Takei, Yamanashi-ken (JP)

(73) Assignee: NISCA CORPORATION, Minamikoma-gun, Yamanashi-ken (JP)

( * ) Notice: Subject to any disclaimer, the term of this patent is extended or adjusted under 35 U.S.C. 154(b) by 138 days.

(21) Appl. No.: 14/750,372

(22) Filed: Jun. 25, 2015

(65) Prior Publication Data

US 2015/0375957 A1 Dec. 31, 2015

(30) Foreign Application Priority Data

Jun. 30, 2014 (JP) ..... 2014-133797

(51) Int. Cl.
*B65H 45/18* (2006.01)

(52) U.S. Cl.
CPC ... *B65H 45/18* (2013.01); *B65H 2301/51232* (2013.01); *B65H 2701/13212* (2013.01); *B65H 2801/27* (2013.01)

(58) Field of Classification Search
CPC ..... B65H 2701/13212; B65H 2301/51232; B65H 2301/4505; B65H 45/18; B65H 23/16
See application file for complete search history.

(56) References Cited

U.S. PATENT DOCUMENTS 8,201,815 B2 * 6/2012 Sasahara ..... B65H 45/18 270/32
2006/0263174 A1 * 11/2006 Oikawa ..... B42C 5/00 412/33

FOREIGN PATENT DOCUMENTS

JP 4217640 B2 2/2009
JP 2014-076903 A 5/2014

* cited by examiner

*Primary Examiner* — Jennifer Simmons
(74) *Attorney, Agent, or Firm* — Manabu Kanesaka

(57) ABSTRACT

Provided is a sheet processing device capable of preventing a folded sheet bundle from being opened after pressing to improve accumulating property and aligning property of the sheet bundle. A sheet processing device B that presses a folded sheet bundle includes a pair of pressing rollers 70 that press a fold of the folded sheet bundle in a thickness direction of the fold, a pressing roller unit 56 that moves the pressing roller pair 70 along the fold of the folded sheet bundle, and a cam member 80 that regulates an interval between the pressing roller pair 70. When the pressing roller unit 56 is moved along the fold of the folded sheet bundle to press the fold in the fold thickness direction, the cam member 80 reduces stepwise the interval between the pressing roller pair 70 in accordance with a moving direction of the pressing roller unit 56.

11 Claims, 19 Drawing Sheets

SHEET PROCESSING DEVICE, IMAGE FORMING DEVICE PROVIDED WITH THE SAME, AND FOLDED SHEET PRESSING METHOD

BACKGROUND OF THE INVENTION

Field of the Invention

The present invention relates to a device for folding a sheet bundle formed by sheets that are sequentially carried out from an image forming device such as a copier or a printer and accumulated in a bundle and, more particularly, to a sheet processing device that performs pressing against a fold of a two-folded sheet bundle.

Description of the Related Art

There are widely known processing devices that align sheets carried out from an image forming device, bind them, and fold them into a booklet. Among them, some processing devices are configured to saddle-stitch the sheet bundle with a staple or an adhesive and fold the sheet bundle into a booklet.

Such a device performs folding for sheet bundle formed by about 20 to 30 sheets in half; however, there may be a case where the two-folded sheet bundle is unintentionally opened after being discharged from the device, degrading aligning property of the sheet bundle, which results in reduction in accumulation amount.

Thus, it is widely known that, after the folding, the two-folded sheet bundle is subjected to pressing from above and below the fold.

For example, Japanese Patent No. 4,217,640 discloses a device that moves along a fold of a two-folded sheet bundle while pinching/pressing the fold by means of rollers disposed above and below the fold. This device is also provided with a flattening roller that presses the fold from a front side thereof at a position slightly rearward of the pinching/pressing position of the upper and lower rollers. That is, in this device, the rollers that pinch/press the fold from thereabove and therebelow and flattening roller that presses the fold from the front side thereof are formed into one unit, and this unit is moved along the sheet folding direction. Thus, only a portion that is pinched by the rollers can be made flat, thereby reducing wrinkles and breaks of a portion other than the fold due to a difference in gripping force.

Further, as illustrated in detail in FIGS. 11 and 12, Japanese Patent No. 4,217,640 discloses, as a device of a second embodiment of the specification, a device in which a unit provided with a flattening roller that presses the fold from the front side thereof and pinching roller pairs that are arranged at front and rear of the flattening roller so as to pinch/press the fold from thereabove and therebelow moves along the sheet folding direction. A device of such a type moves from outside one end portion of the sheet bundle in its width direction toward inside and passes the other end portion thereof while pinching/press the fold by means of the pinching roller pairs to thereby flatten a back-folded portion.

Further, Jpn. Pat. Appln. Laid-Open Publication No. 2014-76903 discloses a processing device provided with a pair of pressing rollers that press a fold of a two-folded sheet bundle in a sheet width direction and a moving unit that reciprocates the pressing roller pair in the sheet width direction. Further, this processing device is configured to move the pressing roller pair between a position where they are separated away from each other and a position where they are brought into pressure contact with each other. Upon pressing the sheet bundle, the moving unit moves inward from an end portion in the sheet width direction with the pressing roller pair separated away from each other and then moves from the inside to one end portion of the sheet bundle while pressing the sheet bundle. After passing the one end portion, pressing by the pressing roller pair is released to separate the pressing roller pair away from each other. When moving again for pressing, the moving unit passes the one end position of the sheet bundle with the pressing roller pair separated away from each other and then moves from the inside to the other end portion of the sheet bundle while pressing the sheet bundle. In other words, the pressing against the fold of the sheet bundle is started from the inside in the sheet width direction to the one or the other end portion of the sheet bundle.

The above-described devices that perform pressing against the folded sheet bundle carried out from an image forming device or the like have the following problems, respectively.

In the device disclosed in Japanese Patent No. 4,217,640, the roller pair that is previously brought into a pressure contact state is moved along the fold, so that even if the roller pair is reciprocated many times, the roller pair presses the same position, that is, the folded positions are overlapped in a straight line, with the result that the folded sheet bundle may be opened after the pressing. Thus, an accumulating property and an aligning property of the folded sheet bundle cannot be effectively improved.

Also, in the device disclosed in Jpn. Pat. Appln. Laid-Open Publication No. 2014-76903, the pressing against the fold of the sheet bundle by means of the pressing roller pair is repetitively performed with the same pressing force, so that, as in the case of the device disclosed in Japanese Patent No. 4,217,640, the folded positions are overlapped in a straight line, with the result that the folded sheet bundle may be opened after the pressing. Thus, improvement of the accumulating property and aligning property of the folded sheet bundle is conventionally difficult to achieve.

SUMMARY OF THE INVENTION

The present invention has been made in view of the above problems and based on the following idea. That is, when a fold of a folded sheet bundle is subjected to pressing, a plurality of pressing operations are not made for the same position of the fold but for different positions in a thickness direction of the fold, with the result that created fold lines are directed inward in the sheet thickness direction after the last pressing operation.

To solve the above problem, a sheet processing device includes a pair of sheet pressing members that press a fold of the folded sheet bundle in a thickness direction of the fold, a moving member that moves the sheet pressing member pair along the fold of the folded sheet bundle, and an interval regulating member that regulates an interval between the sheet pressing member pair. When the moving member is moved along the fold of the folded sheet bundle to press the fold in the fold thickness direction, the interval regulating member reduces stepwise the interval between the sheet pressing member pair in accordance with a moving direction of the moving member.

The present invention provides the following effects by having the above features.

The first sheet pressing roller pair in the moving direction is moved in a sheet width direction while pressing the folded sheet bundle in the fold thickness direction in a state of being separated from each other to create a fold, and the second sheet pressing roller pair in the moving direction is moved in the sheet width direction while pressing the folded sheet bundle with the interval therebetween reduced to create a new fold, whereby the fold of the folded sheet bundle is directed inward. Thus, the sheet bundle itself is directed to its binding direction, thereby preventing the folded sheet bundle from being opened after the pressing, which allows more sheet bundles to be accumulated.

BRIEF DESCRIPTION OF THE DRAWINGS

FIGS. 17A to 17C are explanatory views illustrating a folded sheet bundle having a plurality of fold lines created as a result of pressing performed by the pressing operation illustrated in FIGS. 7 to 15 and FIGS. 16A to 16E, in which FIG. 17A is a view illustrating a state where the folded sheet bundle is pressed between upper and lower pressing rollers between which a predetermined interval is provided, FIG. 17B is a view illustrating a state where the folded sheet bundle is pressed between the upper and lower pressing rollers whose interval is smaller than the predetermined interval, and FIG. 17C is a view illustrating a state where the folded sheet bundle is pressed between the upper and lower pressing rollers in a pressure contact state;

DESCRIPTION OF THE PREFERRED EMBODIMENTS

Figure 1:
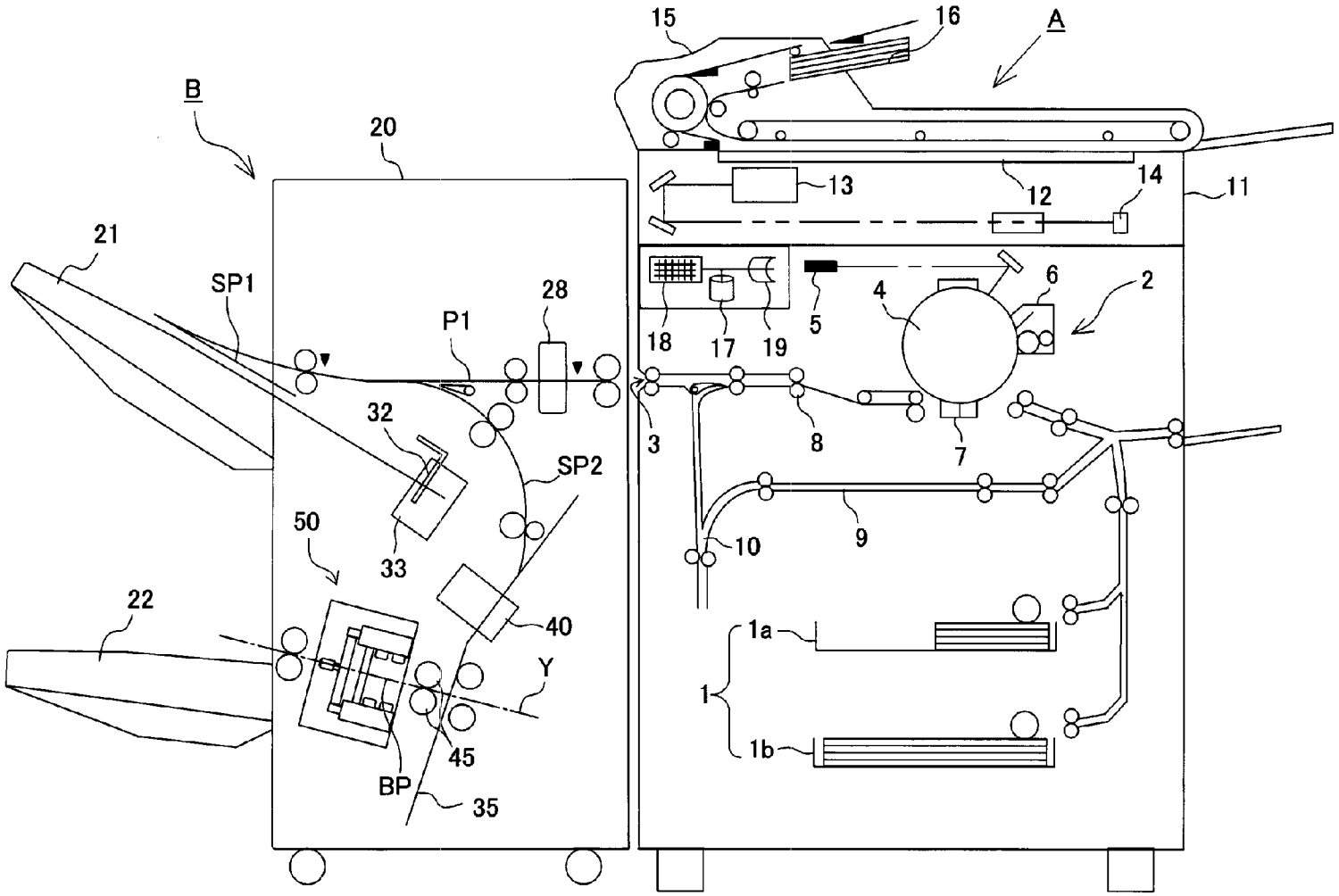
FIG. 1 is an explanatory view of an entire configuration of an image forming system according to the present invention constituted by an image forming device and a sheet processing device incorporating a sheet pressing device.
Figure 2:
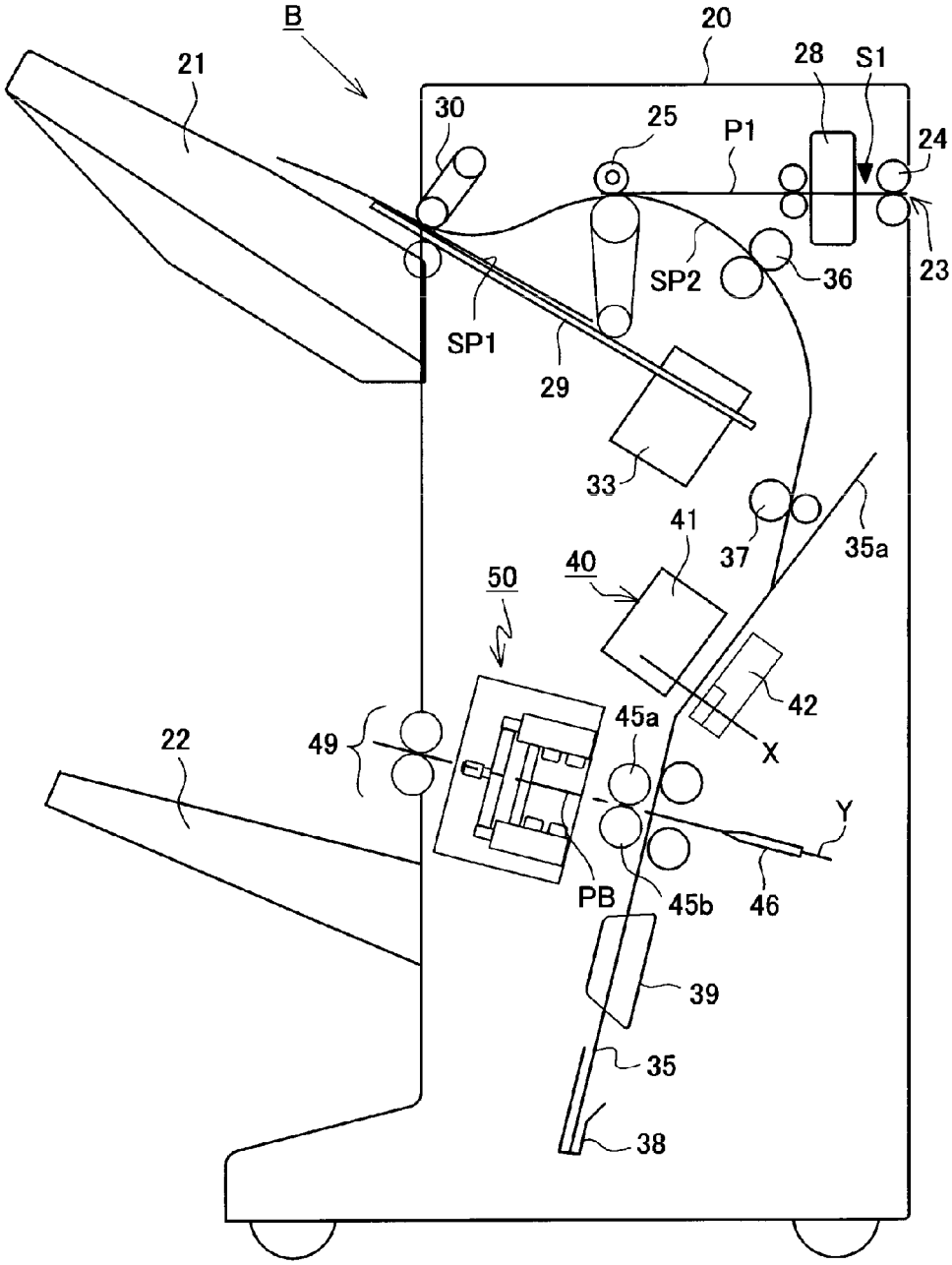
FIG. 2 is an explanatory view of an entire configuration of the sheet processing device according to the present invention that incorporates the sheet pressing device.
Figure 3A:
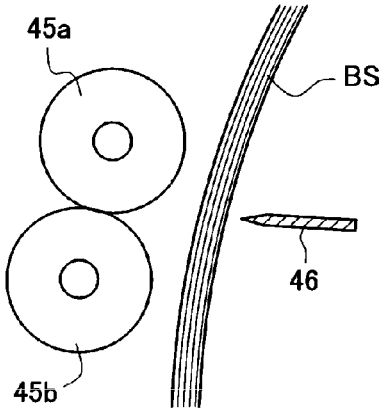
FIGS. 3A to 3D are explanatory views of folding processing performed by a folding roller in the sheet processing device.
Figure 3B:
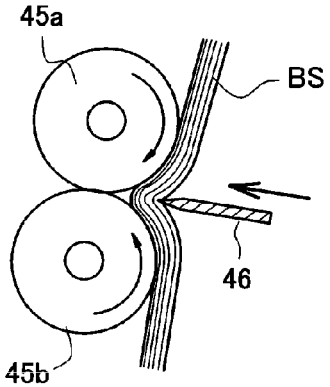
Figure 4:
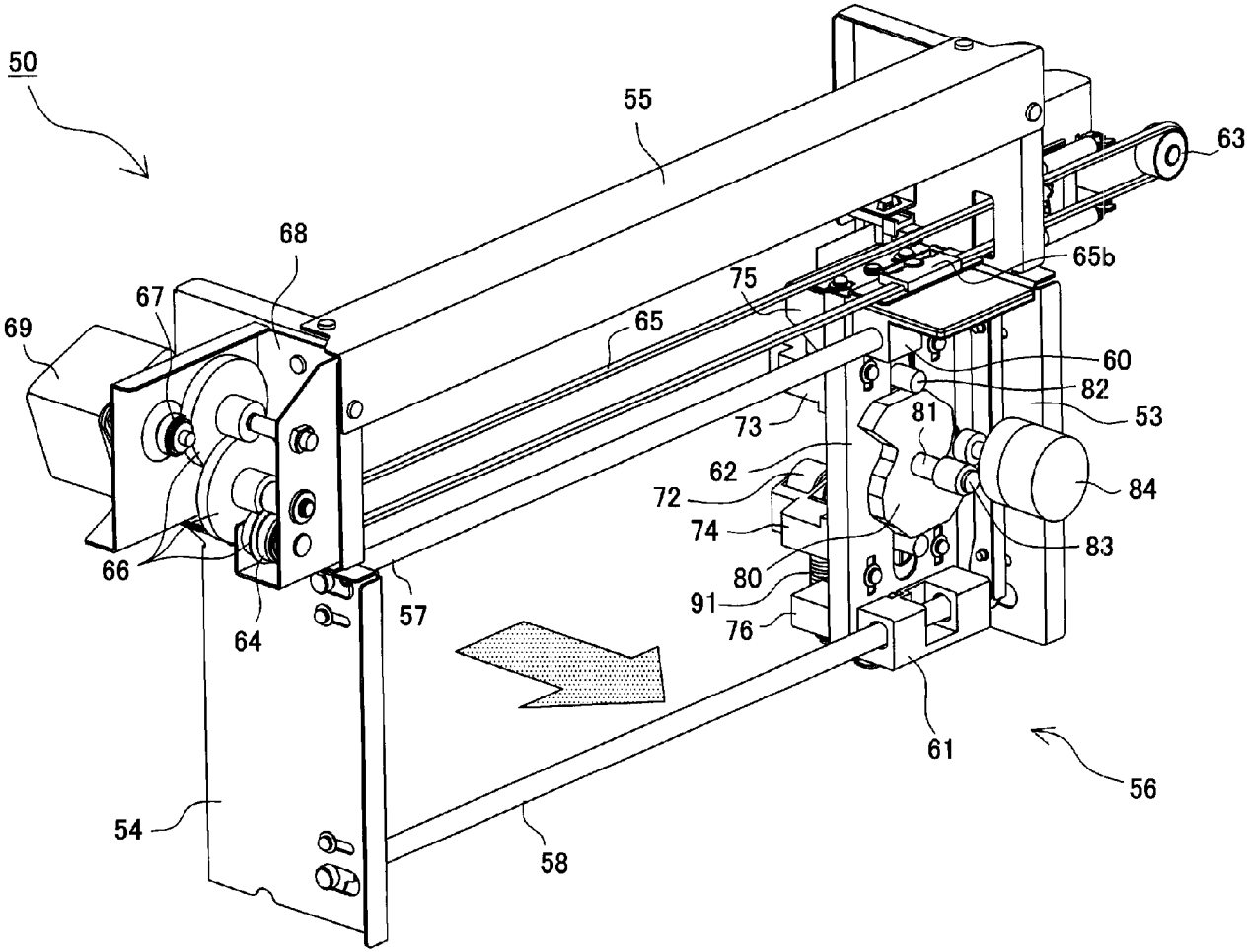
FIG. 4 is a perspective view of the sheet pressing device incorporated in the sheet processing device of FIG. 2 as viewed from a bundle discharge roller side.
Figure 5:
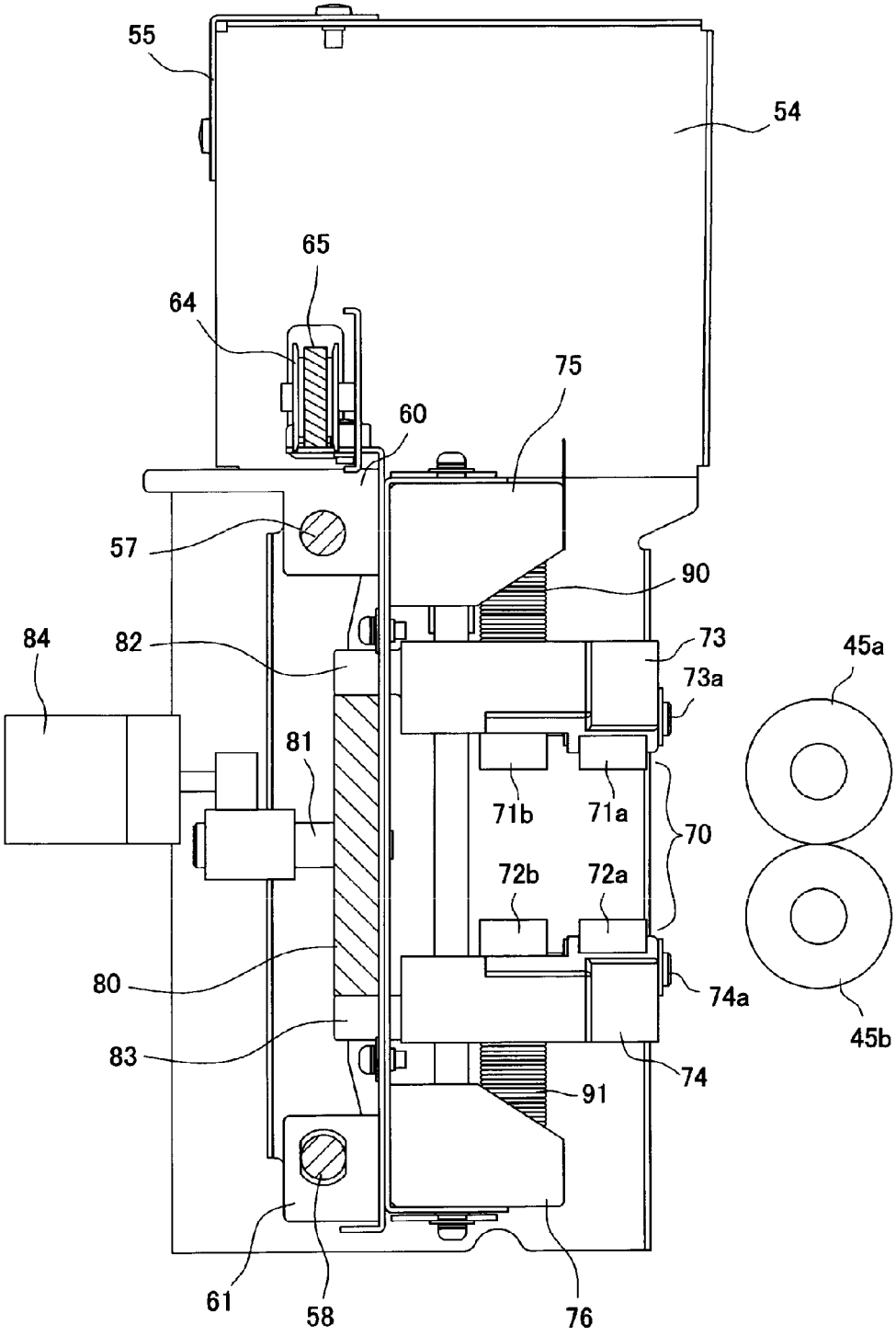
FIG. 5 is a cross-sectional view of the sheet pressing device of FIG. 3.

Hereinafter, the present invention will be described in detail based on illustrated embodiments. FIG. 1 illustrates an entire configuration of an image forming system according to the present invention including an image forming device, FIG. 2 is an explanatory view of an entire configuration of a sheet processing device, and FIGS. 3A to 3D are views explaining a folded state of a sheet bundle in the sheet processing device. FIG. 4 is a perspective view of a sheet pressing device incorporated in the sheet processing device as viewed from the sheet discharge side, and FIG. 5 is a cross-sectional view of the sheet pressing device.

The image forming system illustrated in FIG. 1 is constituted by an image forming device A and a sheet processing device B, and a sheet pressing device 50 is incorporated in the sheet processing device B.

[Configuration of Image Forming Device]

The image forming device A illustrated in FIG. 1 feeds a sheet from a sheet supply section 1 to an image forming section 2, performing printing for the sheet in the image forming section 2, and carries out the resultant sheet from a main body sheet discharge port 3. In the sheet supply section 1, sheets of a plurality of sizes are housed in sheet cassettes 1*a* and 1*b*, respectively, and sheets of a specified size are fed to the image forming section 2 while being separated one from another. The image forming section 2 includes, for example, an electrostatic drum 4, a print head (laser emitter) 5, a developing unit 6, a transfer charger 7, and a fixing unit 8. The print head 5, developing unit 6, transfer charger 7, and fixing unit 8 are disposed around the electrostatic drum 4. In this image forming section 2, the laser emitter 5 forms an electrostatic latent image on the electrostatic drum 4, the developing unit 6 makes toner adhere to the obtained electrostatic latent image, the transfer charger 7 transfers an image onto the sheet, and the fixing unit 8 thermally fixes the image to the sheet. The sheets with the thus formed image are sequentially carried out from the main body sheet discharge port 3. A reference numeral 9 is a circulation path for double-sided printing. More specifically, the sheet on a front side of which the image has been printed is fed from the fixing unit 8, reversed in a main body switchback path 10, and enters the circulation path 9, along which the sheet is fed once again to the image forming section 2 for printing on a back side of the sheet. The thus double-side printed sheet is reversed in the main body switchback path 10 and carried out from the main body sheet discharge port 3.

A reference numeral 11 is an image reading device. The image reading device 11 scans a document sheet set on a platen 12 using a scan unit 13, and light reflected from the document and passing through a reflective mirror and a condenser lens is electrically read by a photoelectric conversion element 14. This image data is subjected to, e.g., digital processing in an image processing section, transferred to a data storage section 17, from which an image signal corresponding to the resultant image data is transmitted to the laser emitter 5. A reference numeral 15 is a document feeder that feeds a document sheet housed in a document stacker 16 to the platen 12.

A controller is provided in the image forming device A having the above configuration, and image formation conditions, for example, print-out conditions such as sheet size designation, color/monochrome printing designation, number-of-copies designation, one-side/two-side printing designation, and scaling printing designation are set through a control panel 18. Further, in the image forming device A, image data read by the scan unit 13 or image data transferred from an external network is stored in the data storage section 17. The image data is transferred from the data storage section 17 to a buffer memory 19, from which data signals corresponding to the image data are sequentially transmitted to the laser emitter 5.

Upon input of the image formation conditions, sheet processing conditions are also input (designated) through the control panel 18. Through input of the sheet processing conditions, the following modes are designated. The image forming device A forms an image on the sheet according to the image formation conditions and post processing conditions.

[Configuration of Sheet Processing Device]

The sheet processing device B connected to the above-described image forming device A is configured to receive the image-formed sheet from the main body sheet discharge port 3 of the image forming device A and perform sheet processing according to one of the following modes.

The modes include: (1) "print-out mode" in which the image-formed sheet is housed in a first sheet discharge tray 21; (2) "staple-binding mode" in which the sheets from the main body sheet discharge port 3 are aligned in a bundle, bound by an end face stapler 33, and housed in the first sheet discharge tray 21; (3) "saddle stitching and folding mode" in which the sheets from the main body sheet discharge port 3 are aligned in a bundle in a stacker section 35 which is a second processing tray, bound at a portion near a center thereof using a saddle stitching stapler 40, folded into a booklet, and stored in a second sheet discharge tray 22; and (4) "folded sheet pressing mode" in which a sheet loop is pressed at a fold of a sheet bundle that has been saddle-stitched and folded into a booklet and then stored in the second sheet discharge tray 22.

As illustrated in FIG. 2, the sheet processing device B includes, in a casing 20 thereof, the first and second sheet discharge trays 21 and 22 and a sheet carry-in path P1 having a carry-in port 23 connected to the main body sheet discharge port 3. The sheet carry-in port P1 is constituted by a straight line path extending in a substantially horizontal direction. Further, first and second switchback conveying paths SP1 and SP2 are branched from the sheet carry-in path P1, along which the sheet is conveyed in a reverse direction to the conveying direction of the sheet conveyed on the sheet carry-in path P1. The first switchback conveying path SP1 is branched from the sheet carry-in path P1 at a path downstream side, and the second switchback path SP2 is branched from the sheet carry-in path P1 at a path upstream side. The first and second switchback conveying paths SP1 and SP2 are distanced from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding the sheet to the second switchback conveying path SP2, and the piece is coupled to an operation means such as a solenoid. Further, the sheet carry-in path P1 has, on the downstream side of the carry-in roller 24, a stamp means for performing stamping on the sheet fed from the carry-in port 23 or a single-sheet punching unit 28 for punching the sheets fed from the carry-in port 23 one by one.

[Configuration of First Switchback Conveying Path SP1]

The first switchback conveying path SP1 disposed on the downstream side (rear end portion of the device) of the sheet carry-in path P1 as illustrated in FIG. 2 is configured as described below. The sheet carry-in path P1 is provided, at its exit end, with the sheet discharge roller 25 and a processing tray 29 on which the sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart therefrom. The normal/reverse rotation roller 30 is controlled to rotate in a clockwise direction in FIG. 2 when the sheet approaches the processing tray 29 to which the normal/reverse rotation roller 30 is coupled, and to rotate in a counterclockwise direction after a sheet rear end passing through the sheet discharge roller 25 enters the processing tray 29. Thus, the first switchback conveying path SP1 is positioned above the processing tray 29.

Further, the first sheet discharge tray 21 is located downstream of the first switchback conveying path SP1 and is configured to support a leading end of the sheet to be guided to the first switchback conveying path SP1 and the second switchback conveying path SP2.

An end face stapler 33 is disposed at a rear end portion of the processing tray 29 in the sheet discharge direction. The illustrated end face stapler 33 staples a sheet bundle on the processing tray 29 at one or more positions of a rear end edge of the sheet bundle. The staple-bound sheet bundle is discharged onto the first sheet discharge tray 21.

The first switchback conveying path SP1 configured as described above aligns the sheets fed by the sheet discharge roller 25 on the processing tray 29 in the "(2) staple-binding mode" as described above, and the end face stapler 33 staples the sheet bundle at one or more portions of the rear end edge of this sheet bundle. In the "(1) print-out mode", the sheet fed by the sheet discharge roller 25 is not subjected to the switchback, but conveyed along the processing tray 29 and discharged to the first sheet discharge tray 21 by a rotation of the normal/reverse rotation roller 30 in a clockwise direction in FIG. 2.

[Configuration of Second Switchback Conveying Path SP2]

The following describes a configuration of the second switchback conveying path SP2 branched from the sheet carry-in path P1. The second switchback conveying path SP2 is a conveying path for guiding a switchback-conveyed sheet. That is, in a state where the sheet is nipped by the sheet discharge roller 25, rotation of the sheet discharge roller 25 is changed from the normal rotation to the reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and an exit conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheet. A saddle stitching stapler 40 and a folding roller 45 are arranged along the stacker section 35. The configuration of these components will be sequentially described below.

[Configuration of Stacker Section]

The stacker section 35 is formed of a guide member that guides the sheet being conveyed. The stacker section 35 is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 and the folding roller 45 to be described later are arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the exit conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) regulating a sheet leading end of the sheet in the conveying direction is located downstream of the stacker section 35. The stopper 38 is supported by a guide rail and the like so as to be movable along the stacker section 35. The stopper 38 is configured to be movable to a position where the sheet is carried in the stacker section 35 by means of a not illustrated shift means, a position where the sheet bundle is bound at a center thereof in the stacking direction, and a position where the sheet bundle is folded by the folding roller 45. Further, an aligning means 39 for aligning the sheets is provided in the middle of the stacker section 35 in the sheet conveying direction. The aligning means 39 presses a side edge of the sheet for alignment every time the sheet is carried in.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length. The saddle stitching stapler 40 may perform the binding not only by using a metallic staple, but also by using a paper-made staple, by performing press-bonding (without use of the metallic or paper-made staple), or by forming a cut in the paper sheets (without use of the metallic or paper-made staple).

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. As illustrated in FIGS. 3A to 3D, the folding roller 45 is constituted by an upper pressure contact roller 45*a* and a lower pressure contact roller 45*b* which are brought into pressure contact with each other. The upper and lower pressure contact rollers 45*a* and 45*b* each have a length slightly longer than the maximum width of the sheet. The folding roller pair 45 are biased in the pressure contact direction by a not illustrated compression spring. The folding roller pair 45 are each formed of a material, such as rubber, having a comparatively large friction coefficient.

Further, the folding blade 46 configured to be moved toward the pressure contact position of the folding roller pair 45 is disposed so as to be capable of advancing and retreating. After the sheet bundle is saddle-stitched by the saddle stitching stapler 40, the folding blade 46 is moved to push the binding position between the folding roller pair 45 to cause the folding roller pair 45 to be rotated while pressed against each other, whereby the saddle-stitched sheet bundle is center-folded. In the middle of the above folding processing, the folding blade 46 is returned to its original position and waits for the next sheet bundle. A movement path along which the folding blade 46 is moved is illustrated as the folding position Y which coincides with the binding position X of the sheet bundle.

Hereinafter, a procedure of folding processing of the stacked sheet bundle or stacked and saddle-stitched sheet bundle will be described using FIGS. 3A to 3D. The sheets are stopped by the stopper 38 and stacked as a sheet bundle. Then, the stopper 38 is moved upward to allow the saddle stitching stapler 40 to saddle-stitch the sheet bundle at about a center position of the sheet bundle in the sheet conveying direction. After the saddle stitching, the stopper 38 supporting the resultant sheet bundle is moved down and stopped at a position where the sheet binding position coincides with a folding position. This state is illustrated in FIG. 3A. This position coincides with the pressure contact position between the upper and lower pressure contact rollers 45*a* and 45*b* constituting the folding roller 45. Thereafter, the upper and lower pressure contact rollers 45*a* and 45*b* are rotated in the same direction by a not illustrated drive motor, and the folding blade 46 is moved so as to be pushed to the pressure contact position. This state is illustrated in FIG. 3B.

Figure 3C:
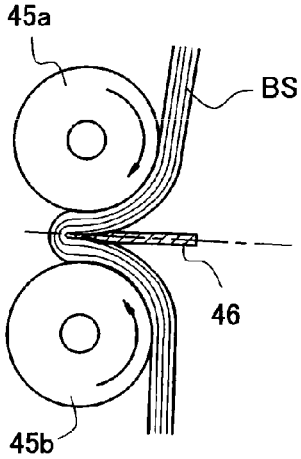
Figure 3D:
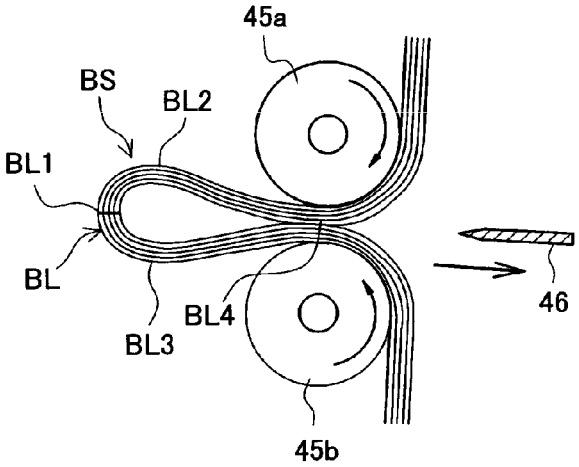

Then, as illustrated in FIG. 3C, the upper and lower pressure contact rollers 45*a* and 45*b* continue being rotated in the same direction, while the folding blade 46 is once stopped before the pressure contact position. Then, the folding blade 46 is retracted in a returning direction. Afterward, when the upper and lower pressure contact rollers 45*a* and 45*b* are further rotated in the same direction, a folded sheet bundle BS to be folded is folded while forming a certain loop BL as illustrated in FIG. 3D. In this state, there are formed a folding loop leading end BL1 which is a fold formed as a result of pushing of the folding blade 46, an upper loop BL2 swelling upward with the folding loop leading end BL1 as a center, a lower loop BL3 swelling downward, and a loop base end portion BL4 that presses the sheets so as to maintain the loop, and the folding operation is once stopped.

The loop at the fold is generated due to action of force for the sheet bundle to be opened outward. Thus, the larger the number of the sheet bundle BS to be folded, the greater the force for the sheet bundle itself to be opened and spread. Accordingly, if no countermeasure is taken, a discharged sheet bundle is opened. So, in the present invention, sheet pressing to be described below is performed.

The folding roller 45 may be used for detecting a thickness of the sheet bundle BS to be folded. That is, by measuring a difference between a distance between axes of the upper and lower pressure contact rollers 45*a* and 45*b* in a state where the sheet bundle BS is not inserted and a distance therebetween in a state where the sheet bundle BS is inserted, the thickness of the sheet bundle BS can be detected.

[Sheet Pressing Device]

Hereinafter, the sheet pressing device constituting a part of the sheet processing device according to the present invention will be described. The sheet pressing device 50 is a device for preventing the folded sheet bundle BS from being opened. First, a configuration of the sheet pressing device 50 will be described with reference to FIG. 4 (perspective view), FIG. 5 (cross-sectional view), and FIG. 6 (front view viewed as the folding roller side), followed by description of operation thereof with reference to FIGS. 7 to 15 and FIGS. 16A to 16E.

As illustrated in FIG. 2, the sheet pressing device 50 is disposed so as to cross a folded sheet conveying path PB installed downstream of the folding roller 45. More in detail, the sheet pressing device 50 performs pressing for the sheet bundle folded in two by the folding roller 45. The sheet pressing device 50 faces the fold of the folded sheet bundle BS having the fold in the sheet width direction and a certain loop.

The sheet pressing device 50 illustrated in FIG. 2 is installed between the folding roller 45 and a bundle discharge roller 49 that discharges the sheet bundle BS outside the device; alternatively however, the sheet pressing device 50 may be disposed downstream of the bundle discharge roller 49 as long as it crosses the folded sheet conveying path PB.

As illustrated in FIG. 4, in the sheet pressing device 50, a connecting angle 55 connecting a right side plate 53 and a left side plate 54 disposed at one side of the device is used to constitute the entire frame of the device. A pressing roller unit 56 is disposed between the right side plate 53 and the left side plate 54 so as to be reciprocated therebetween. The pressing roller unit 56 configured to be reciprocated is slidably moved along an upper guide rail 57 and a lower guide rail 58 extending between the right side plate 53 and the left side plate 54. More specifically, the pressing roller unit 56 is supported such that an upper slide block 60 attached to an upper portion of the pressing roller unit 56 is slid along the upper guide rail 57 and a lower slide block 61 attached to a lower portion of the pressing roller unit 56 is slid along the lower guide rail 58.

A moving belt 65 is provided above the pressing roller unit 56 so as to be stretched between the right side plate 53 and the left side plate 54. A right pulley 63 that winds the moving belt 65 is provided at the right side plate 53 side, and a left pulley 64 that winds the moving belt 65 is provided at the left side plate 54 side. One end of the moving belt 65 is fixed to a belt fixing portion 65*b* at an upper end of the pressing roller unit 56. Thus, when the moving belt 65 is moved to move the belt fixing portion 65*b* from a device back side (right side) to a device front side (left side), the pressing roller unit 56 is moved from the device back side (right side) to the device front side (left side) along the upper guide rail 57 and the lower guide rail 58. When the moving belt 65 is moved in the opposite direction, the belt fixing portion 65*b* is also moved in the opposite direction, which moves the pressing roller unit 56 in the opposite direction. Thus, the pressing roller unit 56 is a moving member that is moved by means of the moving belt 65 and the like.

The left pulley 64 that winds the moving belt 65 is mounted to a motor gear unit 68 provided on the left side plate 54 and connected to a drive motor 69 as a drive member configured to be rotatable in normal and reverse directions through the motor gear unit 68. Rotation drive of the drive motor 69 is transmitted from a motor output gear 67 to a transmission gear 66 provided in the motor gear unit 68, and then to the left pulley 64 of the moving belt 65. Thus, selecting a rotating direction of the drive motor 69 allows the pressing roller unit 56 to be moved selectively in the directions from the device back side (right side) to the device front side (left side) and from the device front side (left side) to the device back side (right side).

[Pressing Roller Unit 56]

The following describes the pressing roller unit 56 configured to be reciprocated left and right. As illustrated in FIG. 4, which is a view as viewed from the bundle discharge roller 49 side, upper pressing rollers 71*a*, 71*b* (collectively referred to as an upper pressing roller 71) and lower pressing rollers 72*a*, 72*b* (collectively referred to as a lower pressing roller 72) as a pair of upper and lower sheet pressing members (corresponding to a pressing roller 70) are disposed on one side surface of a pressing base plate 62. Further, there is provided a cam member 80 as an interval regulating member for regulating an interval between the upper pressing roller 71 and the lower pressing roller 72. Details of the cam member 80 will be described later.

Figure 6:
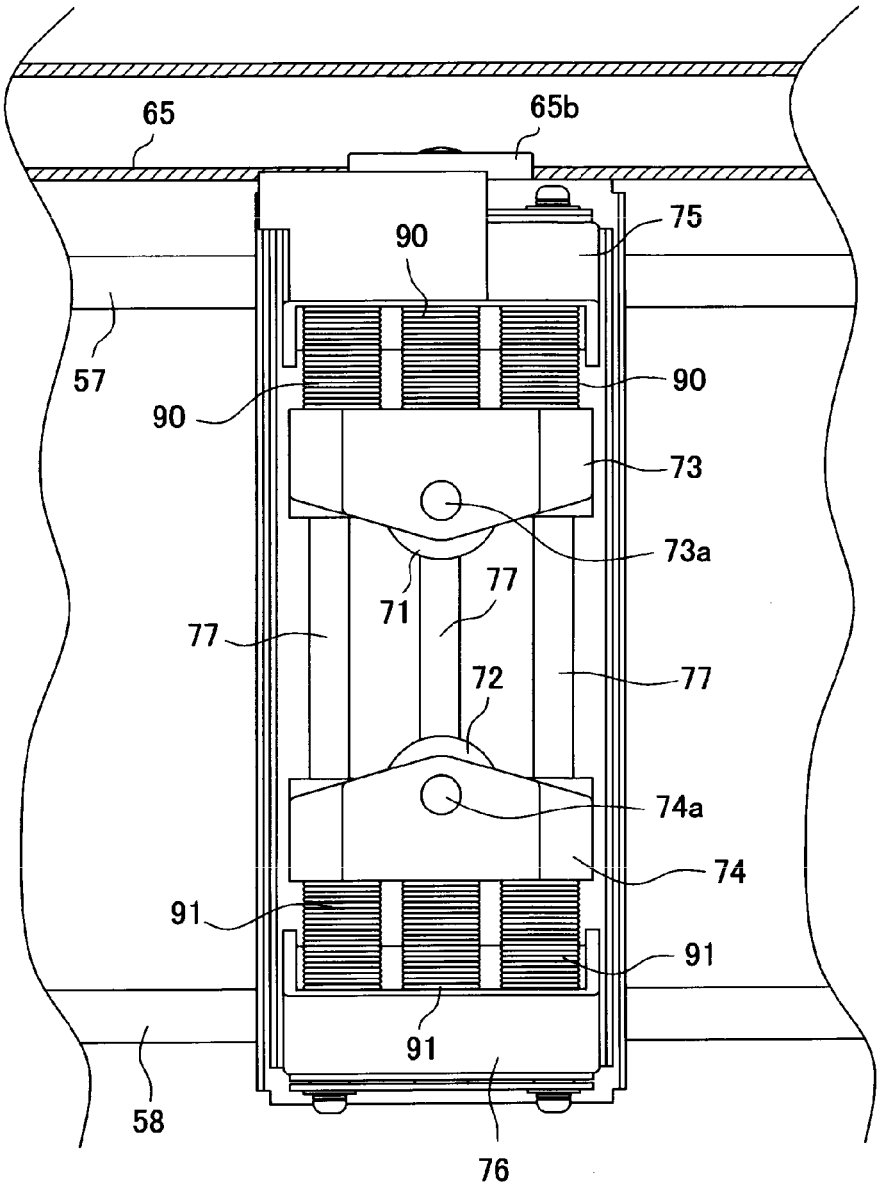
FIG. 6 is a front view of the sheet pressing device of FIG. 2 as viewed from a folding roller side.

As illustrated in FIGS. 5 and 6, vertical movement of the upper and lower pressing rollers 71 and 72 is achieved by an upper pressing roller support block 73 and a lower pressing roller support block 74 which are configured to vertically slid along three roller support block slide rails 77 extending between a roller support upper block 75 and a roller support lower block 76. Further, the upper pressing roller support block 73 is biased downward in FIG. 6 with a constant biasing force by an upper spring 90 interposed between the upper pressing roller support block 73 and the roller support upper block 75. Similarly, the lower pressing roller support block 74 is biased upward in FIG. 6 with a constant biasing force by a lower spring 91 interposed between the lower pressing roller support block 74 and the roller support lower block 76. Thus, the upper and lower pressing roller support blocks 73 and 74 are biased in a direction facing each other with a constant biasing force. The roller support upper and lower blocks 75 and 76 serve also as spring holders of the upper and lower springs 90 and 91, respectively.

As illustrated in FIG. 5, the upper pressing roller 71 is supported by the upper pressing roller support block 73 by means of an upper pressing roller support shaft 73*a* such that a longitudinal direction thereof coincides with a folded sheet conveying direction (direction crossing a fold direction). Thus, the upper pressing roller 71 can be rotated about the support shaft 73*a* disposed in the direction (direction same as the sheet conveying direction) crossing the fold direction. Further, the upper pressing roller 71 is constructed of two series of the upstream side upper pressing roller 71*a* and downstream side upper pressing roller 71*b* arranged in the folded sheet conveying direction. The lower pressing roller 72 has the same configuration as that of the upper pressing roller 71.

The pressing roller 70 need not include the two series of pressing rollers but may be constructed of a single pressing roller.

As described above, there is provided the cam member 80 as the interval regulating member for regulating the interval between the upper and lower pressing rollers 71 and 72. A configuration of the cam member 80 is as follows. Referring back to FIG. 4, an upper regulating pin 82 of the upper pressing roller support block 73 supporting the upper pressing roller 71 and a lower regulating pin 83 of the lower pressing roller support block 74 supporting the lower pressing roller 72 each protrude from the pressing base plate 62 to a back surface side thereof. Positions of the upper and lower regulating pins 82 and 83 are retained by cam surfaces of the cam member 80 against the elastic force of the upper and lower springs 90 and 91 as the elastic member. In the present embodiment, as the elastic force of each of the upper and lower springs 90 and 91, about 4 kg is applied when the interval between the upper and lower springs 90 and 91 is 0 mm.

Hereinafter, with reference to FIGS. 4, 5, and 6, the cam member 80 as an interval setting means for setting the interval between the upper and lower pressing rollers 71 and 72 of the pressing roller 70 as the sheet pressing member by regulating the upper and lower regulating pins 82 and 83. The cam member 80 is fixed to a cam drive shaft 81 as a rotation axis to be described later. As illustrated in FIGS. 4 and 5, the cam drive shaft 81 is rotated by a cam drive motor 84 operated at a reduced speed by a gear unit, thereby allowing the cam member 80 to be rotated. The cam member 80 has cam surfaces that regulate the upper and lower regulating pins 82 and 83, respectively.

Figure 9:
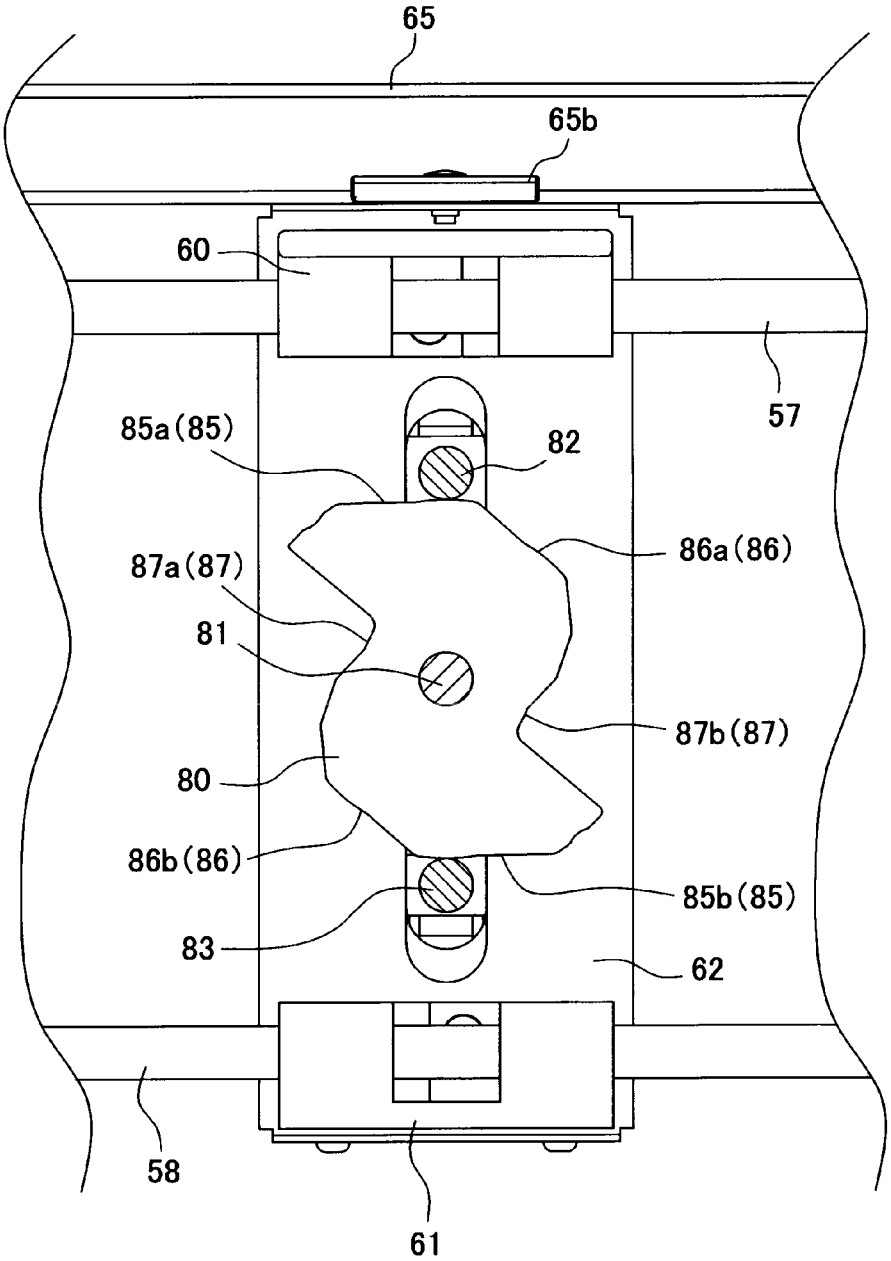
FIG. 9 is a front view as viewed from the bundle discharge roller side, illustrating a position of an interval regulating member (cam member) in the state of FIG. 7.

Referring to FIG. 9, the cam member 80 has first separated cam surfaces 85 that regulate the upper and lower regulating pins 82 and 83 at the largest interval, second separated cam surfaces 86 an interval between which is smaller than that between the first separated cam surfaces 85 by a predetermined value, and pressure contact cam surfaces 87 that release a position-regulated state of the upper and lower regulating pins 82 and 83 that bring the upper and lower pressing rollers 71 and 72 into a pressure contact state. More specifically, the cam member 80 has, as the first separated cam surfaces 85, a first separated upper cam surface 85*a* and a first separated lower cam surface 85*b* which are point-symmetrical with respect to the cam drive shaft 81. Further, the cam member 80 has, as the second separated cam surfaces 86, a second separated upper cam surface 86*a* and a second separated lower cam surface 86*b*. Further, the cam member 80 has, as the pressure contact cam surfaces 87, a pressure contact upper cam surface 87*a* and a pressure contact lower cam surface 87*b*.

As described above, each of the upper and lower cam surface pairs are point-symmetrical to each other. That is, a shape of the cam member 80 before rotation and that of the cam member 80 after rotation by 180° about the cam drive shaft 81 are the same as each other. This is for making the upper and lower pressing rollers 71 and 72 being moved by substantially the same distance with the cam drive shaft 81 as a rotation center axis by rotation of the cam member 80 by a predetermined amount. This allows the upper and lower pressing rollers 71 and 72 (pressing roller 70) to press the folded sheet bundle BS substantially uniformly from both sides in the thickness direction of the fold. Thus, the upper and lower pressing rollers 71 and 72 constitute a sheet pressing member that presses the folded sheet bundle.

As described above, the upper and lower pressing rollers 71 and 72 as the sheet pressing member of the present invention can be moved both in the sheet fold direction which is the left-right width direction of the sheet to be conveyed between the left and right side plates 53 and 54 of FIG. 4 and the fold thickness direction crossing the sheet fold direction. Further, the rotatable configuration of the cam member 80 allows the upper and lower pressing rollers 71 and 72 to be substantially equally moved in the vertical direction, thereby allowing the interval therebetween to be reduced stepwise. Further, it is possible to bring the upper and lower pressing rollers 71 and 72 into pressure contact with each other.

[Operation of Sheet Pressing Device]

Figure 7:
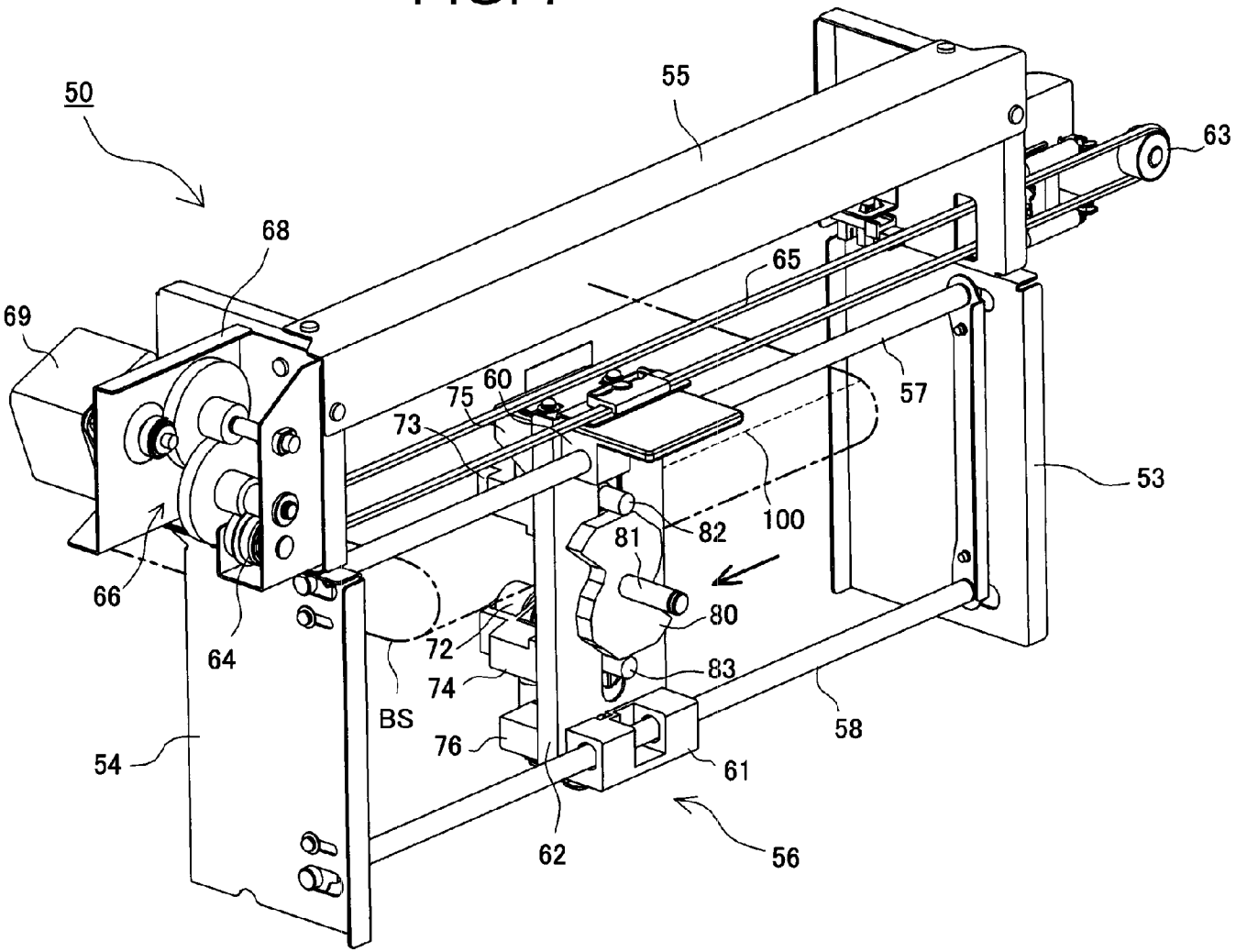
FIG. 7 is a perspective view as viewed from the bundle discharge roller side, illustrating a state where a pair of sheet pressing members press a sheet bundle with a predetermined interval provided therebetween.
Figure 8:
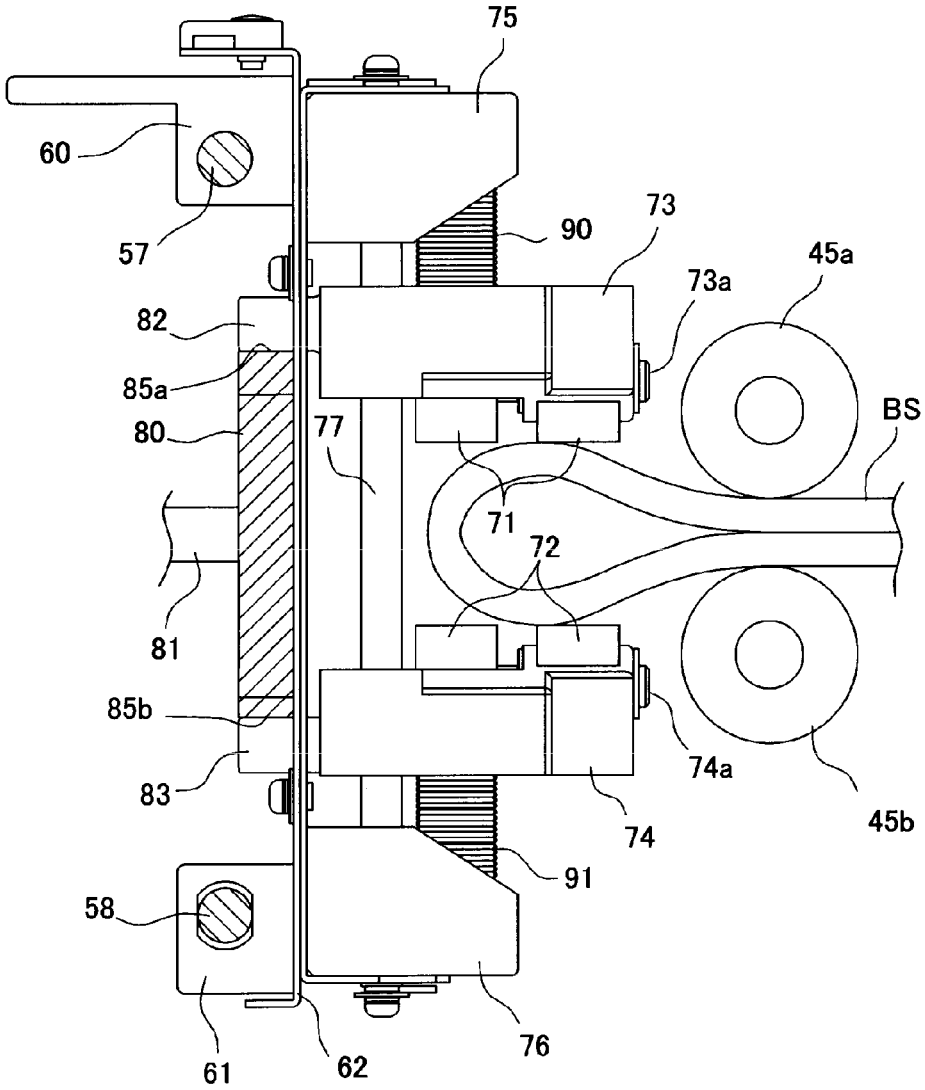
FIG. 8 is a cross-sectional view illustrating the state of FIG. 7.
Figure 10:
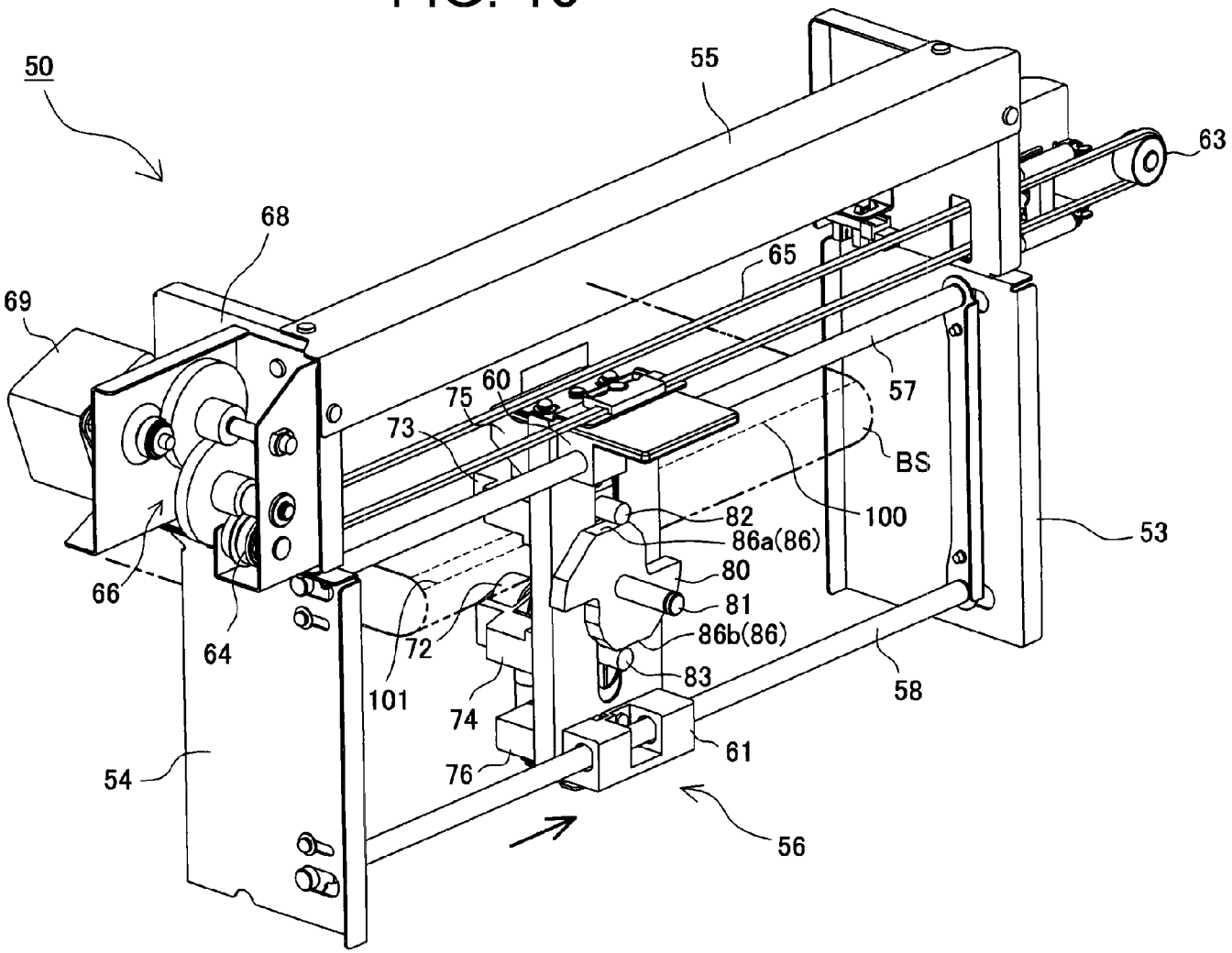
FIG. 10 is a perspective view as viewed from the bundle discharge side, illustrating a state where the folded sheet bundle is pressed with an interval between the pair of sheet pressing members reduced by one level.
Figure 11:
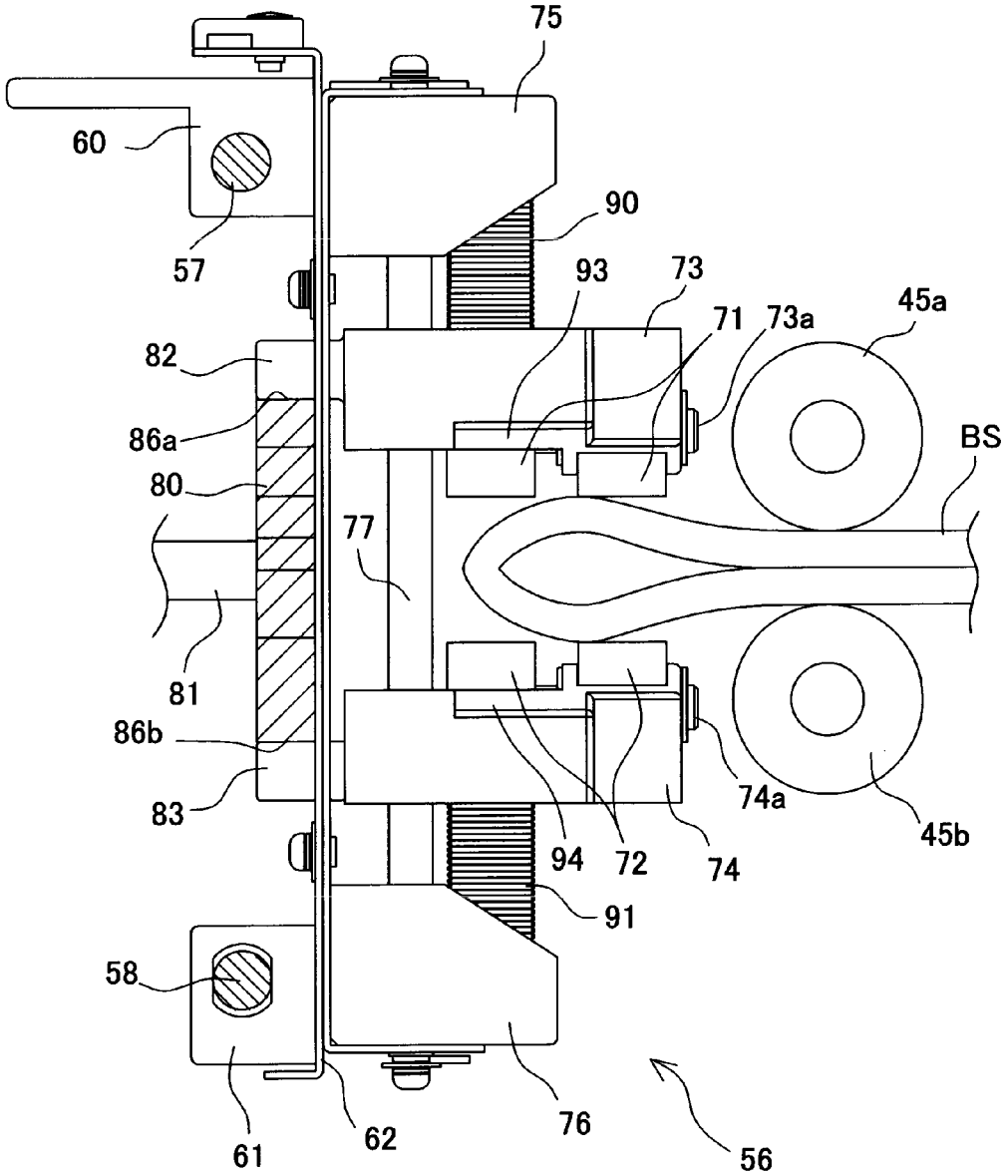
FIG. 11 is a cross-sectional view illustrating the state of FIG. 10.
Figure 12:
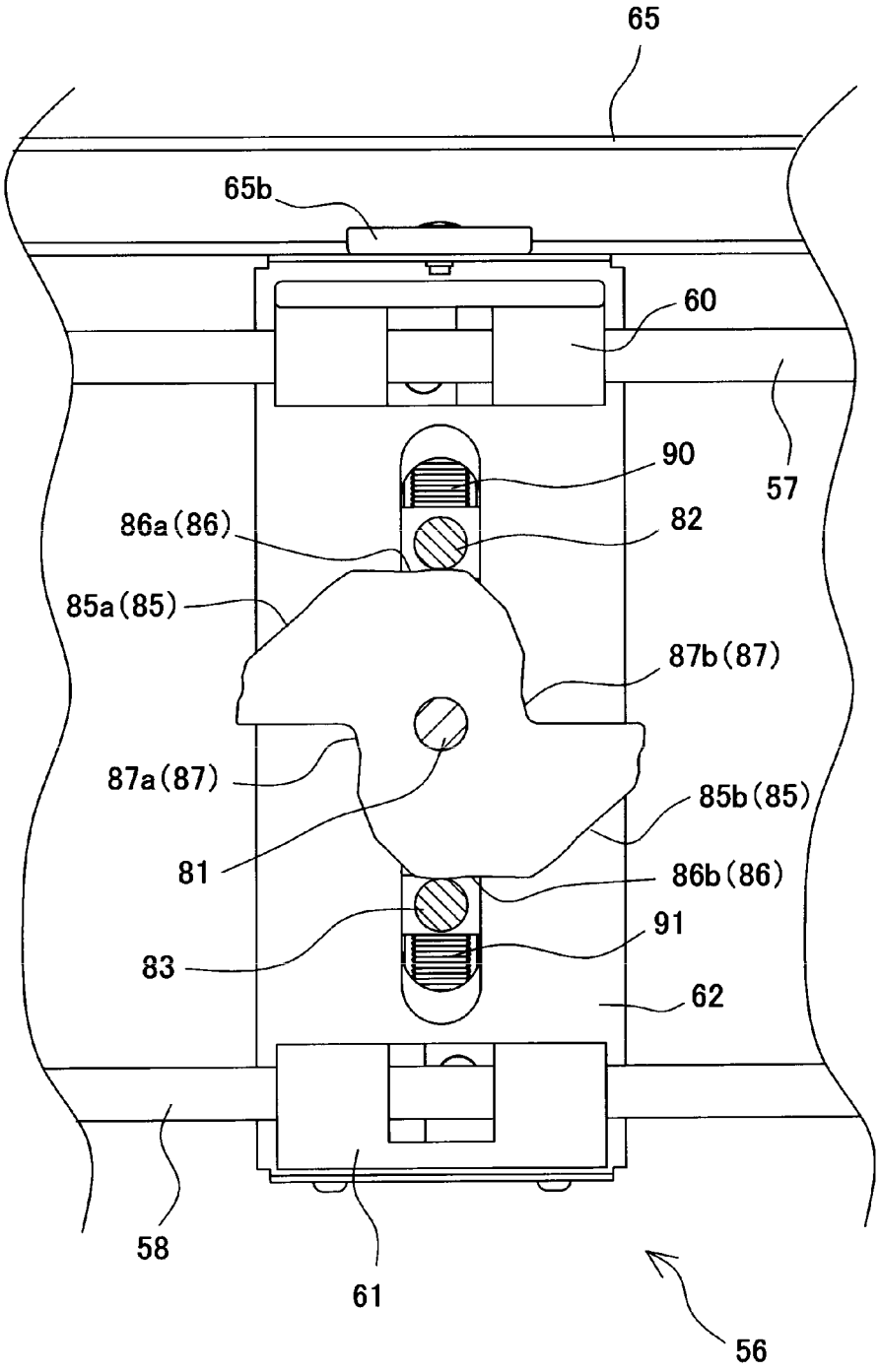
FIG. 12 is a front view as viewed from the bundle discharge roller side, illustrating a position of the interval regulating member (cam member) in the state of FIG. 10.
Figure 13:
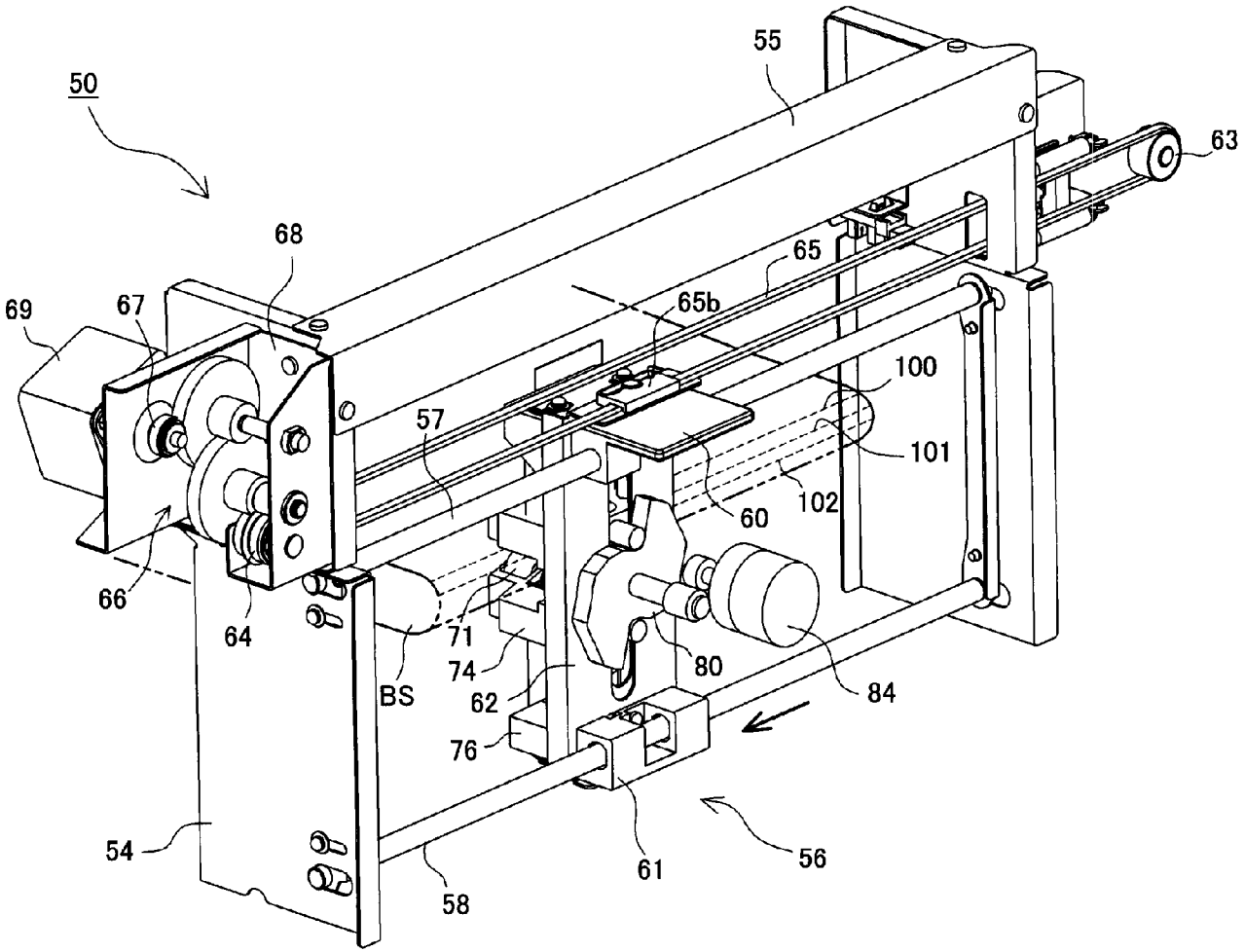
FIG. 13 is a perspective view as viewed from the bundle discharge roller side, illustrating a state where the folded sheet bundle is pressed by the pair of sheet pressing member in a pressure contact state.
Figure 14:
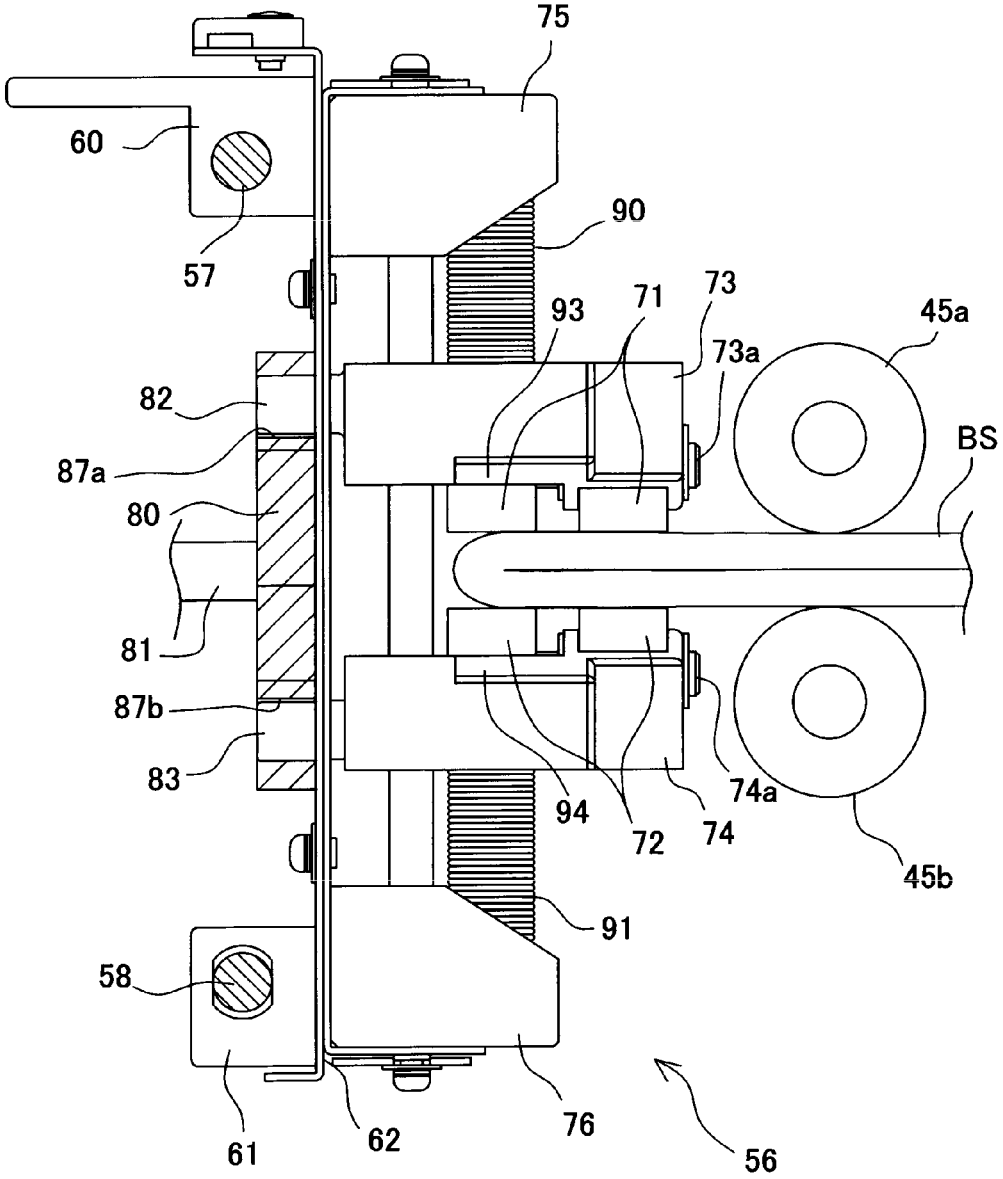
FIG. 14 is a cross-sectional view illustrating the state of FIG. 13.
Figure 15:
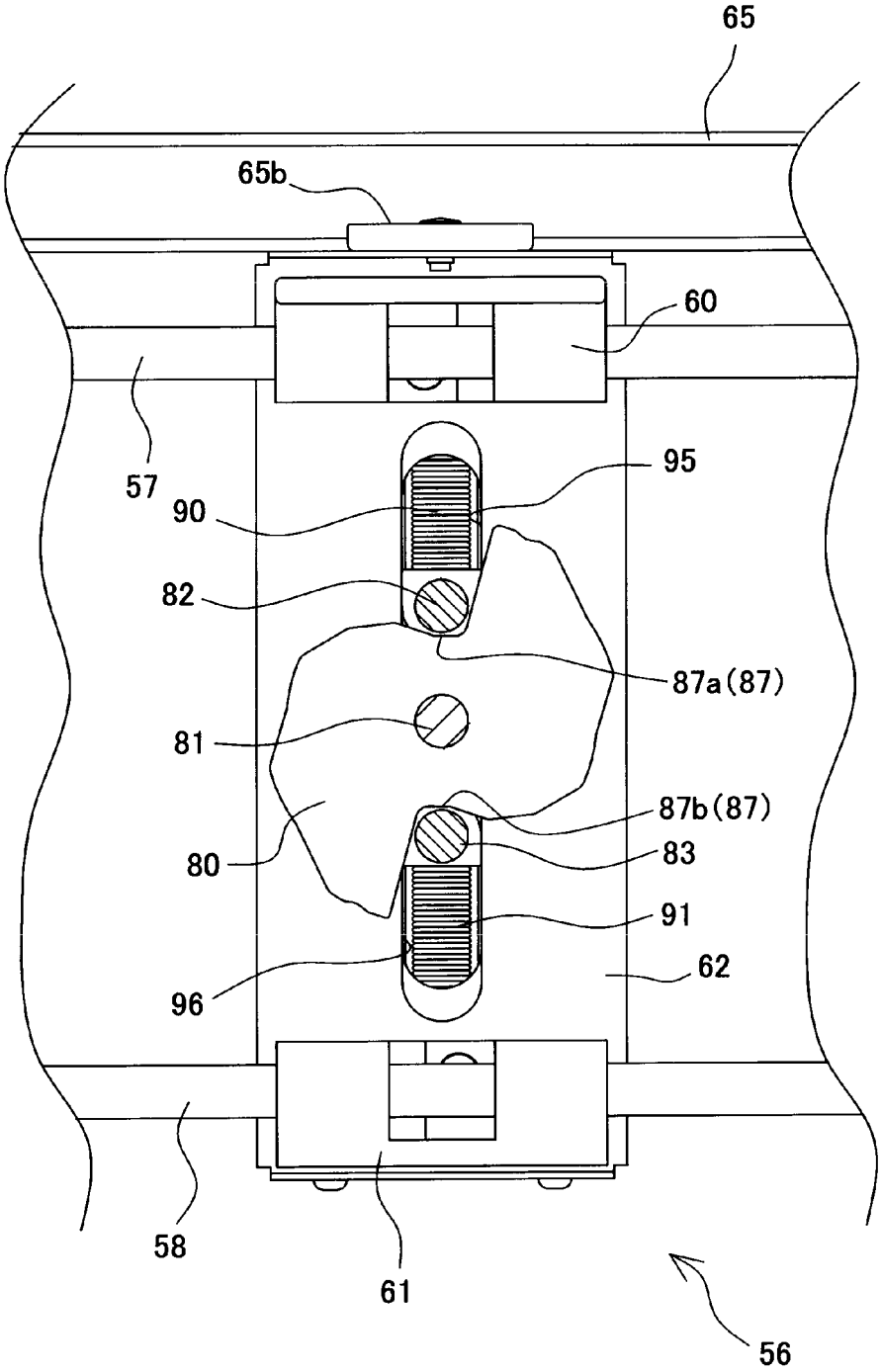
FIG. 15 is a front view as viewed from the bundle discharge roller side, illustrating the position of the interval regulating member (cam member) of FIG. 13.

Hereinafter, carry-in of the folded sheet bundle BS to the sheet pressing device 50 and stepwise pressing operation will be described with reference to FIGS. 7 to 15. FIGS. 7 to 9 illustrate a state where the upper and lower pressing rollers 71 and 72 (pressing roller 70) override one end portion of the folded sheet bundle BS, move along the fold, and pass through the other end portion thereof to perform a first-step pressing at the largest interval. FIGS. 10 to 12 illustrate a state where the upper and lower pressing rollers 71 and 72 (pressing roller 70) move along the fold of the folded sheet bundle BS to perform a second-step pressing at a reduced interval. FIGS. 13 to 15 illustrate a state where the upper and lower pressing rollers 71 and 72 (pressing roller 70) move along the fold of the folded sheet bundle BS to press the fold in a pressure contact state.

First, the first-step pressing operation for the folded sheet bundle BS will be described with reference to FIGS. 7 to 9. In the perspective view of FIG. 7, the pressing roller unit 56 situated at the home position on the right side plate 53 side is moved toward the left side plate 54 along the fold of the folded sheet bundle BS. At the home position, prior to the movement of the pressing roller unit 56, the cam drive motor 84 is driven so as to make the cam member 80 illustrated in FIGS. 7 to 9 regulate the interval between the upper and lower regulating pins 82 and 83 with the first separated cam surfaces 85. This drive state is monitored by a not illustrated cam position detection sensor and a not illustrated encoder provided inside the cam drive motor 84. The sheet bundle BS is tow-folded by the folding roller 45 to form a loop at a position overlapping the upper and lower pressing rollers 71 and 72 as illustrated in FIG. 8. After the loop of the folded sheet bundle BS is formed, the pressing roller unit 56 is moved to the left while creating a fold as illustrated in FIG. 7.

In the present embodiment, a size of the maximum loop is set to about 22 mm, and the interval between the upper and lower pressing rollers 71 and 72 in the first step is set to about 14 mm, so that the upper and lower pressing rollers 71 and 72 overlap the upper and lower portions of the loop, respectively, each by a length of about 4 mm. Thus, the upper and lower pressing rollers 71 and 72 override the end portion of the folded sheet bundle BS in the width direction and move along the fold while pressing the loop of the folded sheet bundle BS. In the one-way movement along the fold, the interval between the upper and lower pressing rollers 71 and 72 is regulated by the first separated cam surfaces 85 of the cam member 80 so as not to become smaller. As a result of this movement, a first fold line 100 is created along the fold of the folded sheet bundle BS. This point will be described in detail later using FIGS. 17A to 17C and FIG. 18.

Next, the second-step pressing operation for the folded sheet bundle BS will be described with reference to FIGS. 10 to 12. In the perspective view of FIG. 10, the pressing roller unit 56 moved from the right side plate 53 to the left side plate 54 is returned toward the right side plate 53 in a direction indicated by an illustrated arrow and situated at a center position between the left and right side plates 54 and 53. At the position on the left side plate 54 side, prior to the return movement of the pressing roller unit 56, the cam drive motor 84 is driven so as to make the cam member 80 regulate the interval between the upper and lower regulating pins 82 and 83 with the second separated cam surfaces 86.

This drive state is monitored by a not illustrated cam position detection sensor and a not illustrated encoder provided inside the cam drive motor 84. The sheet bundle BS retains the loop at a position overlapping the upper and lower pressing rollers 71 and 72 in the second step. The pressing roller unit 56 is moved to the right while creating a second-step fold on the loop of the folded sheet bundle BS as illustrated in FIG. 10.

In the present embodiment, the interval between the upper and lower pressing rollers 71 and 72 in the first step is set to about 14 mm. In the second step, the interval is set to about 7 mm. Thus, the upper and lower pressing rollers 71 and 72 overlap the respective upper and lower portions of the folded sheet bundle that has been pressed in the first step, each by a length of about 3.5 mm. Thus, as in the case of the first step, the upper and lower pressing rollers 71 and 72 override the end portion of the folded sheet bundle BS in the width direction and move along the fold while pressing the loop of the folded sheet bundle BS. In the movement along the fold, the interval between the upper and lower pressing rollers 71 and 72 is regulated by the second separated cam surfaces 86 of the cam member 80 so as not to become smaller. As a result of this movement, a second fold line 101 to be described later is created along the fold of the folded sheet bundle BS toward the right side plate 53 side.

Finally, the third-step pressing operation for the folded sheet bundle BS will be described with reference to FIGS. 13 to 15. In the perspective view of FIG. 13, the pressing roller unit 56 moved from the left side plate 54 to the right side plate 53 is returned toward the left side plate 54 and situated at the center position between the left and right side plates 54 and 53. At the home position on the right side plate 53 side, prior to the return movement of the pressing roller unit 56, the cam drive motor 84 is driven so as to bring the pressure contact surfaces 87 of the cam member 80 into pressure contact with the upper and lower regulating pins 82 and 83, respectively. This drive state is monitored by a not illustrated cam position detection sensor and a not illustrated encoder provided inside the cam drive motor 84.

In the first and second steps, the cam member 80 uses the first separated cam surfaces 85 and the second separated cam surfaces 86, respectively, to regulate the interval between the upper and lower regulating pins 82 and 83 so as not to reduce the interval any more. On the other hand, in the final step, a gap is provided between the pressure contact surfaces 87 and respective upper and lower regulating pins 82 and 83. This means that, if the folded sheet bundle BS is not inserted between the upper and lower pressing rollers 71 and 72, the upper and lower pressing rollers 71 and 72 are brought into pressure contact with each other by the upper and lower springs 90 and 91. Thus, the upper and lower pressing rollers 71 and 72 move along the fold of the folded sheet bundle BS while pressing the fold in the thickness direction of the fold without being regulated by the cam member 80 in terms of the interval therebetween. That is, the fold created by the folding roller is pressed by the pressing roller 70 once again.

In the present embodiment, the interval between the upper and lower pressing rollers 71 and 72 in the second step is set to about 7 mm. In the final step, the interval between the upper and lower pressing rollers 71 and 72 is set so as to allow the fold of the folded sheet bundle BS to be pressed harder in the thickness direction thereof. Thus, the upper and lower pressing rollers 71 and 72 override, along the fold created by the folding roller 45, the end portion of the folded sheet bundle BS in the width direction by an amount corresponding to the thickness of the folded sheet bundle BS and move along the fold while pressing the fold. That is, as described later, in the final step, the pressing roller 70 presses a final fold line 102 corresponding to the fold created by the folding roller 45.

[Movement of Sheet Pressing Unit]

The following describes a pressing procedure of the pressing roller unit 56 and a standby position after the pressing operation with reference to FIGS. 16A to 16E illustrating the processes of FIGS. 7 to 15 in a simplified manner.

Figure 16A:
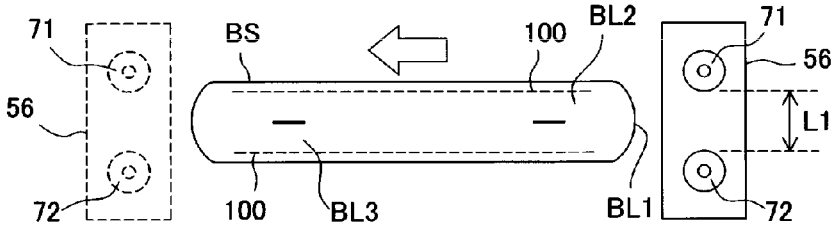
FIGS. 16A to 16E are explanatory views illustrating, in order, an operation of pressing the folded sheet bundle with the interval between the pair of pressing rollers reduced stepwise in accordance with the moving direction of a moving member.

FIG. 16A illustrates a state where the pressing roller unit 56 in the first step illustrated in FIGS. 7 to 9 moves from the home position on the right side in the figure toward a returning position on the left side with the interval between the upper and lower pressing rollers 71 and 72 set to a first interval L1 (in the present embodiment, about 14 mm). By the first movement, a first-step fold line is created on the loop BL of the folded sheet bundle BS.

Figure 16B:
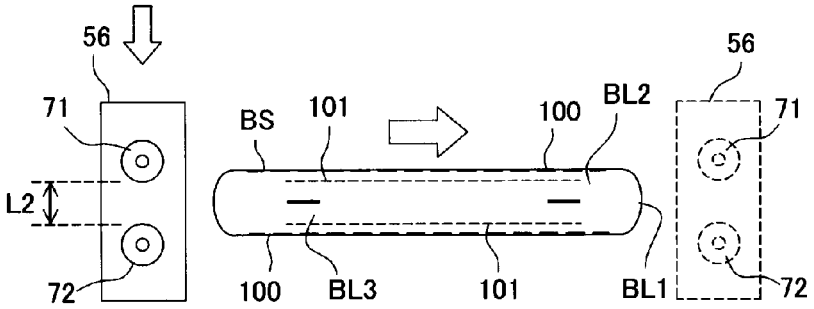

FIG. 16B illustrates the second-step pressing operation of FIGS. 10 to 12. At the returning position on the left side in the figure, the interval between the upper and lower pressing rollers 71 and 72 is changed to a second interval L2 (in the present embodiment, about 7 mm), and the upper and lower pressing rollers 71 and 72 move from the returning position on the left side in the figure to the home position on the right side to press the fold of the folded sheet bundle BS.

Figure 16C:
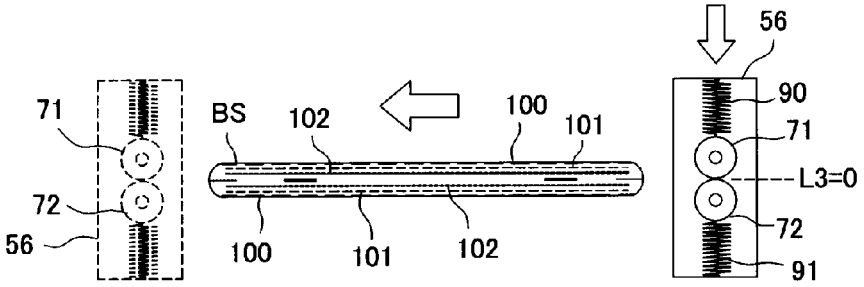

FIG. 16C illustrates the final-stage pressing operation of FIGS. 13 to 15. At the home position on the right side in the figure, the interval between the upper and lower pressing rollers 71 and 72 is set to an interval L3 (in the present embodiment, 0 mm, i.e., free from regulation) to bring the rollers 71 and 72 into a pressure contact state. In this state, the pressing roller unit 56 is moved from the home position on the right side in the figure toward the returning position on the left side. After completion of the three-step pressing operation for the folded sheet bundle BS by the above movement, the folded sheet bundle BS is discharged to the second sheet discharge tray 22 by rotation of the folding roller 45 and the bundle discharge roller 49.

Figure 16D:
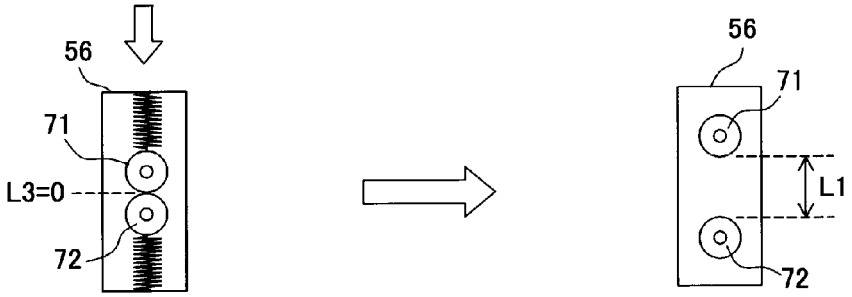

In FIG. 16D, after the discharge of the folded sheet bundle BS, the pressing roller unit 56 is moved from the returning position on the left side toward the home position on the right side with the interval between the upper and lower pressing rollers 71 and 72 kept to L3 (=0, i.e., free from regulation). After this movement, the cam member 80 is driven so as to set the interval between the upper and lower pressing rollers 71 and 72 to the first interval L1 in order for the pressing roller unit 56 to receive a new folded sheet bundle BS from the folding roller 45. In this state, the pressing roller unit 56 waits for carry-in of the new folded sheet bundle BS. The above series of the pressing operation (FIGS. 16A to 16D) is repeated until the number of the folded sheet bundles reaches a specified value.

Figure 16E:
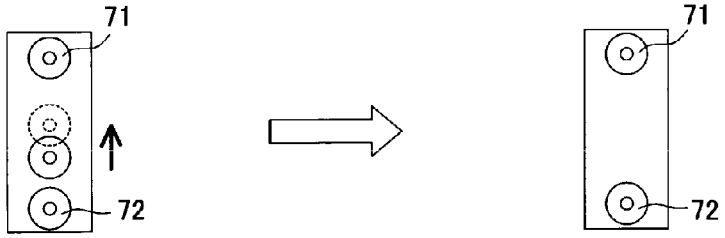

FIG. 16E illustrates a modification of the configuration illustrated in FIG. 16D. That is, in FIG. 16D, the pressing roller unit 56 is returned to the home position on the right side with the upper and lower pressing rollers 71 and 72 kept in a pressure contact state, and then the pressing rollers 71 and 72 are separated from each other by the interval L1 at the home position. Alternatively, however, when the succeeding folded sheet bundle BS is carried in rapidly, the interval between the upper and lower pressing rollers 71 and 72 may be changed from L3 (pressure contact state) to L1 at the returning position before the pressing roller unit 56 starts being returned to the home position. In this case, the pressing roller unit 56 that performs the pressing operation for the loop of the folded sheet bundle BS moves in a reverse direction to that illustrated in FIGS. 16A to 16C.

Further, although not illustrated particularly, the following procedure can be adopted. That is, as illustrated in FIG. 16D, the pressure contact state between the upper and lower pressing rollers 71 and 72 is released, that is, the interval between the pressing rollers 71 and 72 is changed from L3 to L1 after the pressing roller unit 56 has been returned to the home position on the right side; however, the interval may be changed from L3 (pressure contact state) to L1 while the pressing roller unit 56 is being returned from the returning position on the left side to the home position on the right side. In this case, the pressing roller unit 56 that performs the pressing operation for the loop of the folded sheet bundle BS moves in a direction same as that illustrated in FIGS. 16A to 16C, simplifying a control method.

As described above, in the present embodiment, the three-step pressing operation is performed for the two-folded sheet bundle BS by the pressing roller unit 56. The following describes the folded sheet bundle BS in a state after being pressed and discharged with reference to FIGS. 17 and 18.

As described hereinbefore, the upper and lower pressing rollers 71 and 72 (pressing roller 70) as the sheet bundle pressing member of the present invention are moved, along the fold direction, on a part of the folded sheet bundle BS where the fold is created by the folding roller 45 and thus the loop is generated while pressing the folded sheet bundle BS in a thickness direction (vertical direction crossing, at the fold of the folded sheet bundle BS, a conveying direction of the folded sheet bundle BS) of the fold to thereby create a plurality of folds. As described above, in the first step, the interval between the upper and lower pressing rollers 71 and 72 is set to a value (in the present embodiments, about 14 mm relative to the loop size (height) of 22 mm) slightly smaller than the size of the folded sheet bundle loop BL, and the upper and lower pressing rollers 71 and 72 are moved along the fold created by the folding roller 45 to thereby create the first-step fold. In FIGS. 17A to 17C and FIG. 18, the first-step fold is illustrated as a first fold line 100 represented by a light line on the folded sheet bundle BS.

Figure 17A:
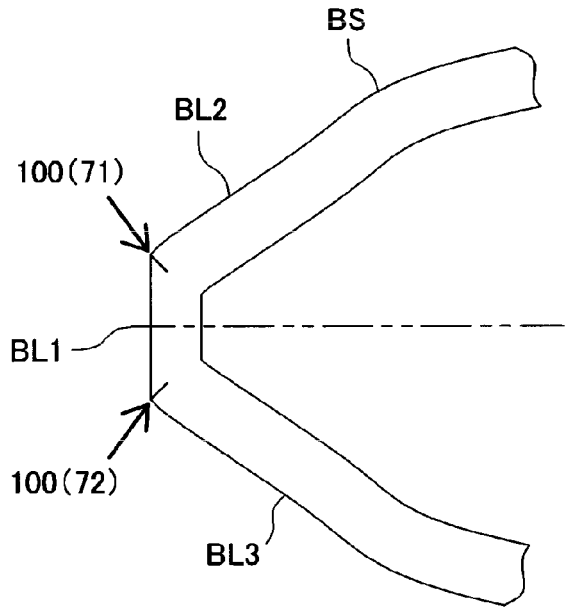
Figure 17B:
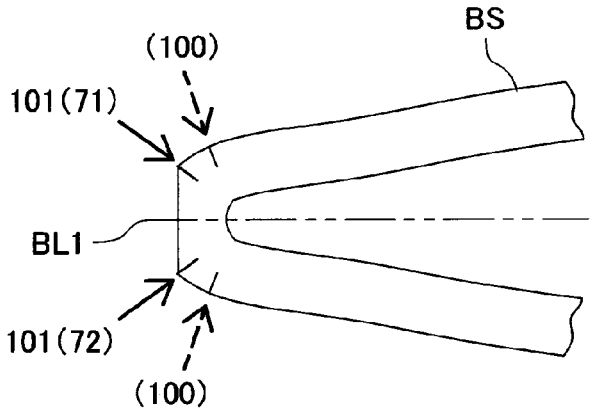
Figure 17C:
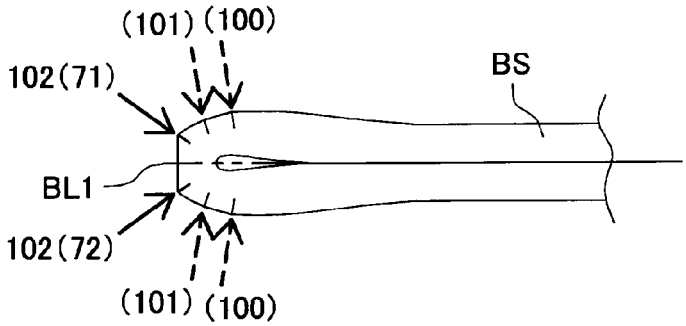
Figure 18:
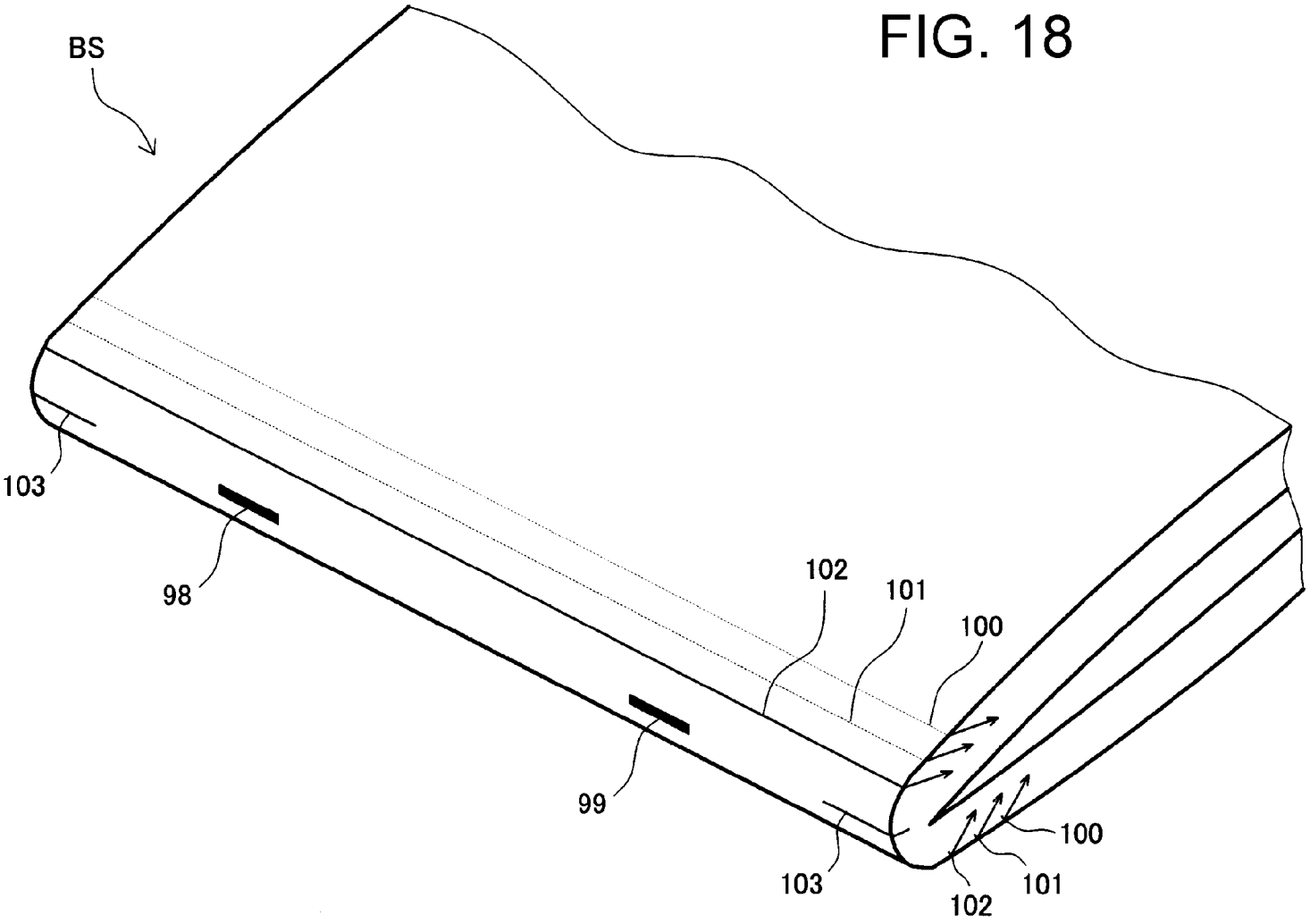
FIG. 18 is a folded sheet bundle in a finished state where the plurality of fold lines are formed therein as a result of pressing operation illustrated in FIGS. 7 to 15 and FIGS. 16A to 16E.

In the second step, the upper and lower pressing rollers 71 and 72, the interval between which is set to a value (in the present embodiments, about 7 mm) slightly smaller than the size of the loop pressed in the first step, are moved along the fold created by the folding roller 45 to thereby create the second-step fold. In FIGS. 17B, 17C and FIG. 18, the second-step fold is illustrated as a second fold line 101 represented by a light line on the folded sheet bundle BS.

In the final step, the upper and lower pressing rollers 71 and 72 are brought into pressure contact with each other by the elastic force of the upper and lower springs 90 and 91. In this final step, unlike the first and second steps, no interval is provided between the upper and lower pressing rollers 71 and 72 (in the present embodiments, interval is set to 0).

Thus, in the final step, the upper and lower pressing rollers 71 and 72 are moved along the fold while pressing the position corresponding to the thickness of the folded sheet bundle BS that has been pressed in the first and second steps. The fold created in the final step is illustrated as a final fold line 102 represented by a comparatively dark line on the folded sheet bundle BS.

At end portions of the folded sheet bundle BS in the width direction, end portion folds 103 created when the folding roller 45 and upper and lower pressing rollers 71 and 72, which are brought into a pressure contact state, override the folded sheet bundle BS are formed.

As described above, the folds are created by the upper and lower pressing rollers 71 and 72 whose interval can be variously changed. As a result, a folding direction is directed to a closing direction (direction of a line extending in the conveying direction that passes the fold) of the folded sheet bundle BS at the respective positions of the first fold line 100 (indicated by the light line) of the first step, the second fold line 101 (indicated by the light line) of the second step, and the final fold line 102 (indicated by the comparatively dark line) of the final step generated in accordance with the thickness of the folded sheet bundle BS. With this configuration, it is possible to prevent the folded sheet bundle BS from being opened after discharge of the folded sheet bundle BS to thereby prevent degradation of aligning property and accumulating property.

[Control Configuration]

Figure 19:
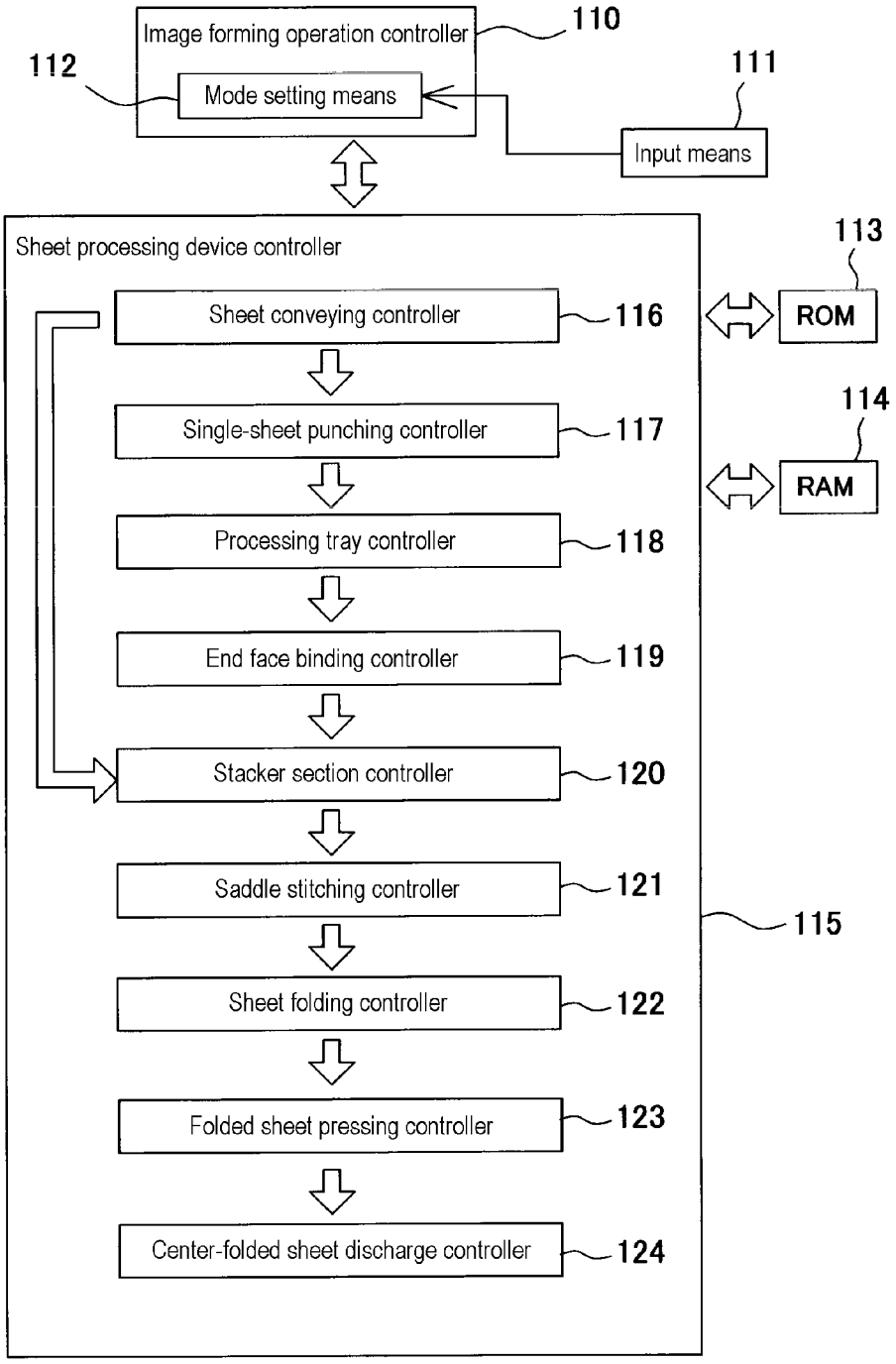
FIG. 19 is an explanatory view of a control configuration of the sheet processing device of FIG. 2.

Control configuration of the sheet processing device B provided with the thus described sheet pressing device 50 and the image forming device A including the sheet processing device B will be described based on a block diagram of FIG. 19. An image forming device controller 110 having an image forming means inputs desired processing through user's operation made to an input means provided on a control panel. This input controls a sheet processing device controller 115 of the sheet processing device B based on a mode setting means.

As described above, in the sheet processing device B of the present invention, the following four modes can be specified: (1) "print-out mode", (2) "staple-binding mode", (3) "saddle stitching and folding mode", and (4) "folded sheet pressing mode".

The sheet processing device B includes the sheet processing device controller 115 that is made operable in one of the above four modes, a ROM that stores an operation program, and a RAM that stores control data. The sheet processing device controller 115 includes a sheet conveying controller 116 that controls sheet conveyance in the device, a single-sheet punching controller 117 that applies punching, one by one, the sheets by means of a single-sheet punching unit 28, a processing tray controller 118 that performs control of accumulating the sheets on the processing tray 29, and an end face binding controller 119 that binds the end face side of the sheets accumulated in a bundle and discharges the bound sheet bundle.

The saddle stitching or the center-folding of the sheet at about a half position thereof in the sheet conveying direction is controlled by a stacker section controller 120 that accumulates the sheet bundle in the sheet stacker section 35. The stacker section controller 120 uses the stopper 38 or the aligning means 39 that regulates the leading end of the sheets carried in, one by one, to the stacker section 35 to generate an aligned sheet bundle. The sheet processing device controller 115 further includes a saddle stitching controller 121 that controls the saddle stitching stapler 40 to drive a staple or the like to a center portion of the sheet bundle and a sheet folding controller 122 that controls the folding blade 46 to push the saddle-stitched sheet bundle into the folding roller 45 to fold the sheet bundle.

The sheet processing device controller 115 further includes a folded sheet pressing controller 123 that controls the sheet pressing device according to the thus described "folded sheet pressing mode". The folded sheet bundle BS that has been pressed is discharged and accumulated in the second sheet discharge tray 22 under control of a center-folded sheet discharge controller 124 that controls the folding roller 45 serving also as a bundle conveying roller and the bundle discharge roller 49.

The folded sheet pressing control related especially to the present invention has been described based on the description of the respective mechanisms and using operation state explanatory views of FIGS. 7 to 15 and FIG. 16, so descriptions thereof will be omitted. The sheet pressing device 50 is controlled so as to execute the sheet pressing based on the contents described.

The present invention in its preferred embodiments provides the following effects.

(1) There is provided, according to the above embodiment, a sheet processing device B that presses a folded sheet bundle, the sheet processing device B including a pair of pressing rollers 70 as a pressing member that press a fold of the folded sheet bundle in a thickness direction of the fold, a pressing roller unit 56 as a moving member that moves the pressing roller pair 70 along the fold of the folded sheet bundle, and a cam member 80 as an interval regulating member that regulates an interval between the pressing roller pair 70, wherein when the pressing roller unit 56 is moved along the fold of the folded sheet bundle to press the fold in the fold thickness direction, the cam member 80 reduces stepwise the interval between the pressing roller pair 70 in accordance with a moving direction of the pressing roller unit 56.

With this configuration, in the first pressing operation performed in the thickness direction of the fold, the pressing roller pair 70 is moved in a sheet width direction with a predetermined interval provided therebetween to create a fold, and in the next pressing operation, the pressing roller pair 70 is moved in the sheet width direction with the interval therebetween reduced to create a new fold, whereby the fold of the folded sheet bundle is directed inward. Thus, the sheet bundle itself is directed to its binding direction, thereby preventing the folded sheet bundle from being opened after the pressing, which allows more sheet bundles to be accumulated.

(2) In the sheet processing device of (1), the pressing roller pair 70 is a pair of rotatable rollers having a support shaft in a direction crossing the fold direction.

With this configuration, the pressing roller pair 70 can be rotated in the moving direction, so that it can override the fold from a sheet end portion and press the fold without catch to thereby perform smooth sheet pressing operation.

(3) In the sheet processing device of (1), the pair of pressing rollers 70 are biased against each other by the upper and lower springs 90 and 91 in a direction facing each other and are position-regulated by the cam member 80 against the biasing force.

With this configuration, when pressing folded sheet bundle formed by rigid sheets, the pressing roller pair 70 can set the fold by being moved upward with downward movement thereof regulated by the cam member 80, whereby the fold can be set at different positions.

(4) In the sheet processing device of (3), the cam member 80 is rotated in accordance with the moving direction of the pressing roller unit 56 to reduce stepwise the interval between the pair of pressing rollers 70.

With this configuration, the interval can be set by the cam member 80, thereby facilitating position setting and thereby making it easy to set a position of the pressing roller pair 70.

(5) In the sheet processing device of (4), the cam member 80 can be rotated about a cam drive shaft 81 serving as a center axis of the cam member 80 and has a shape point-symmetrical with respect to the center axis so as to equally move the pressing roller pair 70.

With this configuration, the cam member 80 has a symmetrical shape, so that the pair of pressing rollers 70 equally approach each other in the sheet thickness direction. Thus, the fold lines created by the pair of pressing rollers 70 are formed at positions substantially equally distant from the sheet fold position, whereby a folded booklet having a good appearance can be created.

(6) In the sheet processing device of (5), in the final step of the movement of the pressing roller unit 56 along the fold of the folded sheet bundle, the position regulation for the pressing roller pair 70 by the cam member 80 is released to cause the folded sheet bundle to be pressed by the pressing roller pair 70 biased by the upper and lower springs 90 and 91.

With this configuration, when the pair of pressing rollers are moved in the final step, they are not position-regulated by the cam member 80, so that the pressing roller unit 56 is moved along the fold while pressing the folded sheet bundle with spring force of the upper and lower springs 90 and 91, thereby reliably pressing the fold of the folded sheet bundle.

(7) In the sheet processing device of (2), one-way movement of the pressing roller unit 56 along the fold of the folded sheet bundle is continued from when the pressing roller pair 70 overrides one end portion of the folded sheet bundle in the fold direction until when the pressing roller pair 70 passes through the other end portion of the folded sheet bundle.

With this configuration, the pressing roller unit 56 can create the folds sequentially while being moved by a distance longer than the width of the folded sheet bundle, whereby a folded booklet having improved pressing effect can be created.

(8) There is provided, according to the above embodiment, a sheet processing device that presses a folded sheet bundle, the sheet processing device including a stacker section 35 that accumulates sheets as a sheet bundle, a folding roller 45 that folds the accumulated sheet bundle, a pair of pressing rollers 70 that press a fold of the sheet bundle folded by the folding roller 45 in a thickness direction of the fold, a pressing roller unit 56 that moves the pressing roller pair 70 along the fold of the folded sheet bundle, a drive belt 65 and a drive motor 69 that reciprocate the pressing roller unit 56 by a distance longer than a width of the folded sheet bundle in the fold direction, upper and lower springs 90 and 91 that bias the pair of pressing rollers 70 in their approaching direction, and a movably configured cam member 80 that regulates, against the biasing force of the upper and lower springs 90 and 91, an interval between the pair of the pressing rollers 70 at a plurality of levels, wherein the folded sheet bundle is pressed in a thickness direction of the fold with the cam member 80 moved in accordance with a moving direction of the pressing roller unit 56 driven by the drive belt 65 and the drive motor 69 so as to reduce the interval between the pair of pressing rollers 70.

With this configuration, in the first pressing operation performed in the thickness direction of the fold, the pressing roller pair 70 is moved in a sheet width direction with a predetermined interval provided therebetween to create a fold, and in the next pressing operation, the pressing roller pair 70 is moved in the sheet width direction with the interval therebetween reduced to create a new fold, whereby the fold of the folded sheet bundle is directed inward. Thus, the sheet bundle itself is directed to its binding direction, thereby preventing the folded sheet bundle from being opened after the pressing, which enhances the aligning property of the sheet bundle and allows more sheet bundles to be accumulated.

(9) There is provided, according to the embodiment, an image forming device A including an image forming means for forming an image on a sheet and a sheet processing device that applies predetermined sheet processing to the image-formed sheet from the image forming means, wherein the sheet processing device is the sheet processing device B described in (1) to (8).

With this configuration, there can be provided the image forming device A having the sheet processing device B capable of providing working effects described in the above respective paragraphs.

(10) There is provided, according to the embodiment, a sheet pressing method of a sheet pressing device including a pair of pressing rollers 70 that press a fold of a folded sheet bundle in a thickness direction of the fold, a pressing roller unit 56 that moves the pressing roller pair 70 along the fold of the folded sheet bundle, and a cam member 80 that regulates an interval between the pressing roller pair 70, wherein, in a first movement of the pressing roller unit 56 along the fold of the folded sheet bundle, the folded sheet bundle is pressed in the thickness direction of the fold with the interval between the pair of pressing rollers 70 set to a comparatively large first interval, and in the next movement of the pressing roller unit 56, the folded sheet bundle is pressed in the thickness direction of the fold with the interval between the pair of pressing rollers 70 set to an interval smaller than the first interval.

With this configuration, the interval between the pair of pressing rollers 70 is reduced stepwise at every movement of the pressing roller unit 56 along the fold of the folded sheet bundle, so that the sheet bundle itself is directed to its binding direction, thereby preventing the folded sheet bundle from being opened after the pressing, which allows more sheet bundles to be accumulated.

In the description of the effects of the embodiments, reference numerals are given to constituent elements recited in the claims so as to clarify a correspondence relationship between the description of "Detailed Description" and the description of "What is Claimed is".

Further, it should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Application No. 2014-133797, filed Jun. 30, 2014, the entire contents of which are incorporated herein by reference.

What is claimed is:

1. A sheet processing device that presses a folded sheet bundle, comprising:

a sheet holding member that holds the folded sheet bundle to maintain a position of the folded sheet bundle;

a pair of sheet pressing members that presses a fold of the folded sheet bundle between the pair of sheet pressing members in a thickness direction of the fold;

a moving member that reciprocates the pair of sheet pressing members along the fold of the folded sheet bundle; and an interval regulating member that regulates an interval between the pair of sheet pressing members, wherein when the moving member is reciprocated along the fold of the folded sheet bundle, the sheet holding member holds the folded sheet bundle without moving the folded sheet bundle, the interval regulating member regulates the interval between the pair of sheet pressing members to reduce stepwise the interval between the pair of sheet pressing members in accordance with a moving direction of the moving member, and the pair of sheet pressing members creates another fold of the folded sheet bundle at a loop thereof and presses the folds in the fold thickness direction.

2. The sheet processing device according to claim 1, wherein the sheet holding member is a pair of folding rollers to form the folded sheet, and the pair of sheet pressing members is a pair of rotatable rollers having a support shaft in a direction crossing a direction of the fold of the folded sheet bundle.

3. The sheet processing device according to claim 2, wherein one-way movement of the moving member along the fold of the folded sheet bundle is continued from when the pair of sheet pressing members overrides one end portion of the folded sheet bundle in the direction of the fold of the folded sheet bundle until when the pair of sheet pressing members passes through the other end portion of the folded sheet bundle.

4. The sheet processing device according to claim 1, wherein the pair of sheet pressing members is biased against each other by an elastic member in a direction facing each other and is position-regulated by the interval regulating member against a biasing force of the elastic member.

5. The sheet processing device according to claim 4, wherein the interval regulating member is a cam member, and the cam member is rotated in accordance with the moving direction of the moving member to reduce stepwise the interval between the pair of sheet pressing members.

6. The sheet processing device according to claim 5, wherein the interval regulating member can be rotated about a center axis thereof and has a shape point-symmetrical with respect to the center axis so as to equally move the pair of sheet pressing members.

7. The sheet processing device according to claim 6, wherein in a final step of a movement of the moving member along the fold of the folded sheet bundle, a position regulation for the pair of sheet pressing members by the interval regulating member is released to cause the folded sheet bundle to be pressed by the pair of sheet pressing members biased by the elastic member.

8. The sheet processing device according to claim 1, further comprising a pair of pressing roller support members supporting the pair of sheet pressing members, and having a pair of regulating pins extending outwardly to engage the interval regulating member, wherein the interval regulating member includes a pair of first cam surfaces symmetrically arranged each other with respect to a center axis of the interval regulating member, a pair of second cam surfaces arranged each other with respect to the center axis thereof and adjacent to the pair of first cam surfaces, and a pair of third cam surfaces arranged each other with respect to the center axis thereof and adjacent to the pair of second cam surface, to form an outer circumference of the interval regulating member, and the pair of sheet pressing members is arranged apart from each other when the pair of regulating pins contacts the pair of first cam surfaces, the pair of sheet pressing members is approached each other when the pair of regulating pins contacts the pair of second cam surfaces, and the pair of sheet pressing members is contacted each other when the pair of regulating pins contacts the pair of third cam surfaces.

9. An image forming device comprising:

an image forming unit that forms an image on a sheet; and a sheet processing device that applies a predetermined sheet processing to an image-formed sheet from the image forming unit, wherein the sheet processing device is the sheet processing device as claimed in claim 1.

10. A sheet processing device that presses a folded sheet bundle, comprising:

a stacker section that accumulates sheets as a sheet bundle;

a folding roller that folds the sheet bundle accumulated on the stacker section, and holds the folded sheet bundle not to move in a direction crossing a direction of a fold of the folded sheet bundle;

a pair of pressing rollers that presses the fold of the folded sheet bundle folded by the folding roller in a thickness direction of the fold;

a moving member that moves the pair of pressing rollers along the fold of the folded sheet bundle;

a drive member that reciprocates the moving member by a distance longer than a width of the folded sheet bundle in the direction of the fold of the folded sheet bundle;

an elastic member that biases the pair of pressing rollers in an approaching direction thereof; and a movably configured cam member that regulates, against a biasing force of the elastic member, an interval between the pair of the pressing rollers at a plurality of levels wherein in a state in which the folded sheet bundle is not moved in the direction crossing the direction of the fold of the folded sheet bundle, the cam member is moved in accordance with a moving direction of the moving member driven by the drive member so as to regulate the interval between the pair of pressing rollers to reduce stepwise the interval between the pair of pressing rollers, and the pair of sheet pressing members creates another fold of the folded sheet bundle at a loop thereof and presses the folds in the fold thickness direction.

11. A sheet pressing method of a sheet pressing device including a folding roller that forms a folded sheet bundle and holds the folded sheet bundle not to move, a pair of sheet pressing members that presses the fold of a folded sheet bundle in a thickness direction of the fold of the folded sheet bundle, a moving member that moves the pair of sheet pressing members along the fold of the folded sheet bundle, and an interval regulating member that regulates an interval between the pair of sheet pressing members at a plurality of positions, comprising:

a holding step of holding the folded sheet bundle without moving the folded sheet bundle by the folding roller, a first pressing step of creating a first fold of the folded sheet bundle apart from the fold thereof by regulating the interval between the pair of sheet pressing members to a first interval, and moving the pair of sheet pressing members in one direction along the fold of the folded sheet bundle, a second pressing step of creating a second fold of the folded sheet bundle between the fold and the first fold thereof by regulating the interval between the pair of sheet pressing members to a second interval shorter than the first interval, and moving the pair of sheet pressing members in the other direction along the fold of the folded sheet bundle, and a third pressing step of pressing the fold, the first fold, the second fold of the folded sheet bundle by releasing regulation of the interval between the pair of sheet pressing members, and moving the pair of sheet pressing members in the one direction along the fold of the folded sheet bundle, wherein the first pressing step, the second pressing step, the third pressing step are performed in the holding step.

* * * * *